US006058700A

United States Patent [19]

Yamashita et al.

[11] Patent Number: 6,058,700

[45] Date of Patent: May 9, 2000

[54] DEVICE FOR PURIFYING EXHAUST GAS OF ENGINE

[75] Inventors: Tetsuya Yamashita, Susono; Toshiaki Tanaka, Numazu; Shinichi Takeshima, Susono; Shinya Hirota, Susono; Eiji Iwasaki, Susono; Kouji Yoshizaki, Numazu; Nobumoto Ohashi, Susono; Kazuhiro Itoh, Mishima, all of Japan

[73] Assignee: Toyota Jidosha Kabushiki Kaisha, Aichi, Japan

[21] Appl. No.: 09/083,738

[22] Filed: May 22, 1998

[51] Int. Cl.[7] ..... F01N 3/00

[52] U.S. Cl. ..... 60/285; 60/276; 60/287; 60/297; 60/324; 60/303

[58] Field of Search ..... 60/285, 286, 276, 60/287, 288, 289, 295, 297, 300, 301, 303, 324

[56] References Cited

U.S. PATENT DOCUMENTS 5,472,673 12/1995 Goto et al. ..... 422/169
5,473,890 12/1995 Takeshima et al. ..... 60/285
5,832,722 11/1998 Cullen et al. ..... 60/274
5,850,735 12/1998 Araki et al. ..... 60/274

FOREIGN PATENT DOCUMENTS 6-88518 3/1994 Japan .

*Primary Examiner*—Thomas Denion
*Assistant Examiner*—Binh Tran
*Attorney, Agent, or Firm*—Kenyon & Kenyon

[57] ABSTRACT

A device for purifying the exhaust gas of an engine comprises a $NO_X$ absorbent arranged in the exhaust passage. The $NO_X$ absorbent absorbs $NO_X$ therein when the air-fuel ratio of the inflowing exhaust gas is lean, and releases the absorbed $NO_X$ therefrom when the oxygen concentration in the inflowing exhaust gas becomes lower. The $NO_X$ absorbent also absorbs $SO_X$ therein when the air-fuel ratio of the inflowing exhaust gas is lean, and releases the absorbed $SO_X$ therefrom when the oxygen concentration in the inflowing exhaust gas becomes lower, with the temperature of the $NO_X$ absorbent being higher than a $SO_X$ releasing temperature. The air-fuel ratio of the exhaust gas flowing to the $NO_X$ absorbent is made rich temporarily when the temperature of the $NO_X$ absorbent is higher than $SO_X$ releasing temperature and when the flow rate of the exhaust gas flowing through the $NO_X$ absorbent is lower than a predetermined flow rate, to release the absorbed $SO_X$ from the $NO_X$ absorbent.

25 Claims, 20 Drawing Sheets

DEVICE FOR PURIFYING EXHAUST GAS OF ENGINE

BACKGROUND OF THE INVENTION

1. Field of the Invention

The present invention relates to a device for purifying the exhaust gas of an engine.

2. Description of the Related Art

If a ratio of the total amount of air fed to the intake passage, the combustion chamber, and the exhaust passage upstream of a certain position in the exhaust passage to the total amount of fuel fed to the intake passage, the combustion chamber, and the exhaust passage upstream of the above-mentioned position, is referred to as an air-fuel ratio of the exhaust gas flowing through the certain position, it is well known that an engine, in which the lean air-fuel mixture is burned, has a $NO_X$ absorbent arranged in the exhaust passage, the $NO_X$ absorbent absorbing $NO_X$ therein when the air-fuel ratio of the inflowing exhaust gas is lean, and releasing the absorbed $NO_X$ therefrom when the oxygen concentration in the inflowing exhaust gas becomes lower. In the engine, the air-fuel ratio of the exhaust gas flowing the $NO_X$ absorbent is made rich temporarily to thereby release the absorbed $NO_X$ from the $NO_X$ absorbent and reduce the $NO_X$.

However, fuel and the lubrication oil contain sulphur containing components, and thus the exhaust gas also contains sulphur containing components, such as $SO_X$. The $NO_X$ absorbent absorbs the $SO_X$ in the form of $SO_4^{2-}$, together with $NO_X$. However, the $SO_X$ is not released from the $NO_X$ absorbent even when the air-fuel ratio of the inflowing exhaust gas is made rich. Thus, the amount of $SO_X$ absorbed in the $NO_X$ absorbent increases gradually. However, if the $SO_X$ amount in the $NO_X$ absorbent increases, the $NO_X$ absorbing capacity of the $NO_X$ absorbent gradually becomes smaller, and at the last, the $NO_X$ absorbent can hardly absorb $NO_X$ therein.

However, the $NO_X$ absorbent releases the absorbed $SO_X$ therefrom in the form of $SO_2$, for example, when the oxygen concentration in the inflowing exhaust gas becomes lower with the temperature of the $NO_X$ absorbent being higher than the $SO_X$ releasing temperature thereof. Japanese Unexamined Patent Publication No. 6-88518 discloses an exhaust gas purifying device for an engine in which the air-fuel ratio of the exhaust gas flowing to the $NO_X$ absorbent is made rich temporarily when the temperature of the $NO_X$ absorbent is higher than the $SO_X$ releasing temperature.

The device mentioned above does not include a device for heating the $NO_X$ absorbent, such as an electric heater. Thus, the temperature of the $NO_X$ absorbent is only higher than the $SO_X$ releasing temperature when the engine load is high, for example. However, at the high load engine operation, the flow rate of the exhaust gas flowing through the $NO_X$ absorbent is high, i.e., the contact period between the exhaust gas and the $NO_X$ absorbent is short. However, the $SO_X$ releasing rate of the $NO_X$ absorbent is relatively low, and thus $SO_X$ is not released from the $NO_X$ absorbent sufficiently, even when the air-fuel ratio of the inflowing exhaust gas is made rich with the temperature of the $NO_X$ absorbent is higher than the $SO_X$ releasing temperature, as long as the contact period is short. Namely, the air-fuel ratio of the exhaust gas flowing to the $NO_X$ absorbent must be made rich for a long time to release the $SO_X$ from the $NO_X$ absorbent sufficiently, if the contact period is short.

SUMMARY OF THE INVENTION

An object of the present invention is to provide a device for purifying an exhaust gas of an engine capable of releasing the absorbed sulphur containing components from the sulphur containing components absorbent quickly and sufficiently.

According to the present invention, there is provided a device for purifying the exhaust gas of an engine having an exhaust passage, comprising: a sulphur containing components absorbent arranged in the exhaust passage, the sulphur containing components absorbent absorbing the sulphur containing components therein when the air-fuel ratio of the inflowing exhaust gas is lean, and releasing the absorbed sulphur containing components therefrom when the oxygen concentration in the inflowing exhaust gas becomes lower with the temperature of the sulphur containing components absorbent being higher than a sulphur containing components releasing temperature of the sulphur containing components absorbent; and releasing means for making the air-fuel ratio of the exhaust gas flowing to the sulphur containing components absorbent stoichiometric or rich temporarily, when the temperature of the sulphur containing components absorbent is higher than the sulphur containing components releasing temperature and when the flow rate of the exhaust gas flowing through the sulphur containing components absorbent is lower than a predetermined flow rate, to release the absorbed sulphur containing components from the sulphur containing components absorbent.

The present invention may be more fully understood from the description of the preferred embodiments of the invention as set forth below, together with the accompanying drawings.

DESCRIPTION OF THE PREFERRED EMBODIMENTS

Figure 1:
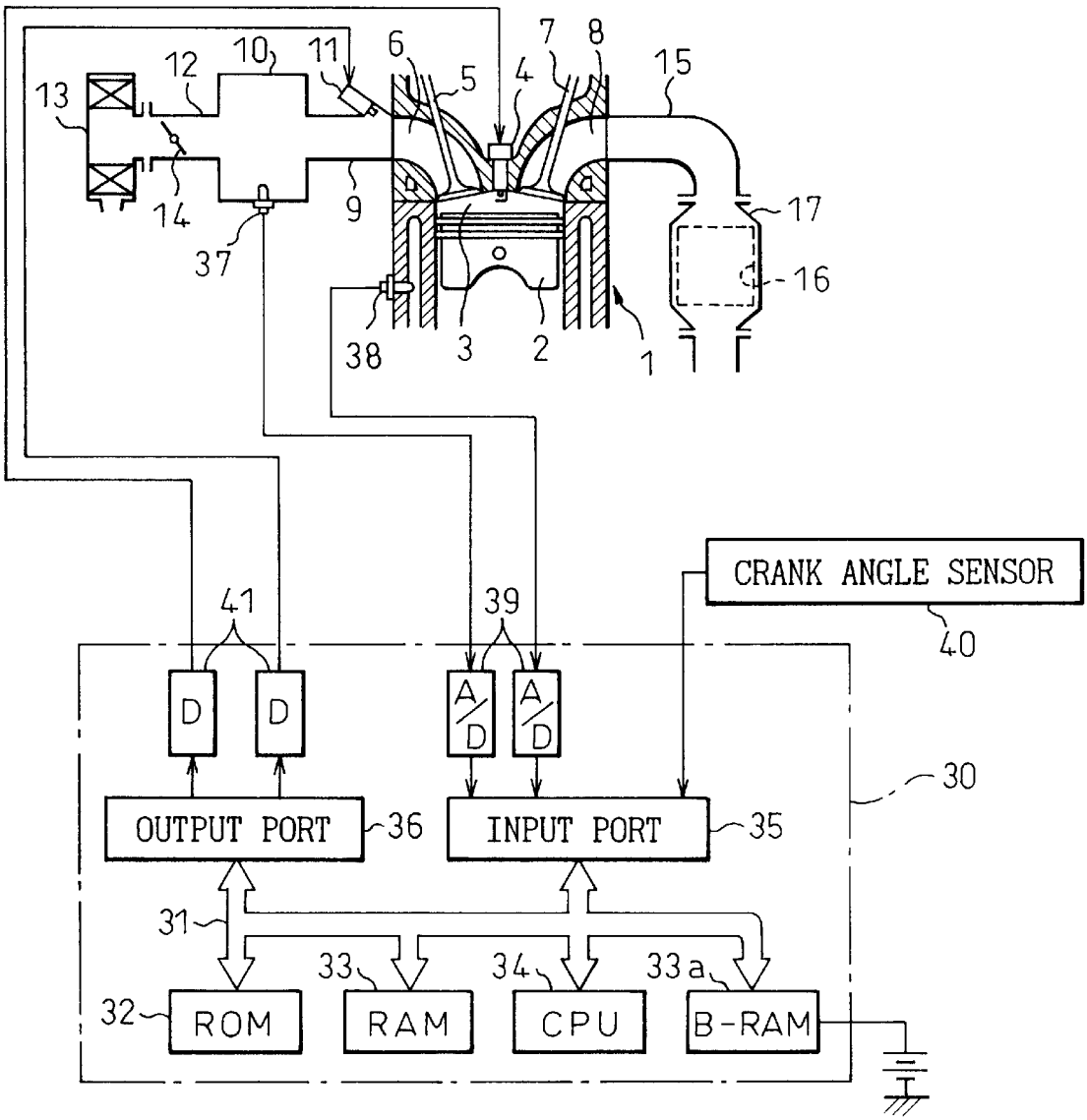
FIG. 1 is a general view of an engine.

FIG. 1 illustrates a case where the present invention is applied to a spark-ignition engine.

Referring to FIG. 1, a reference numeral 1 designates the engine body, 2 designates a piston, 3 designates a combustion chamber, 4 designates a spark plug, 5 designates an intake valve, 6 designates an intake port, 7 designates an exhaust valve, and 8 designates an exhaust port. The intake ports 6 of each cylinder are connected to a common surge tank 10 via corresponding branches 9. A fuel injector injecting fuel to the corresponding intake ports 6 is arranged in each branch 9. The surge tank 10 is connected to an air cleaner 13 via an intake duct 12. A throttle valve 14 is disposed in the intake duct 12. On the other hand, the exhaust ports 8 of each cylinder are connected to a casing 17 housing a $NO_X$ absorbent 16 therein, via an exhaust manifold 15.

The electronic control unit (ECU) 30 is constructed as a digital computer and comprises a read-only memory (ROM) 32, a random-access memory (RAM) 33, a backup RAM 33*a* to which the electric power is always supplied, the CPU (micro processor) 34, an input port 35, and an output port 36, which are interconnected with each other via a bidirectional bus 31. A pressure sensor 37 generating an output voltage in proportion to the pressure in the surge tank 10 is arranged in the surge tank 10. A water temperature sensor 38 generating an output voltage in proportion to the temperature of the engine cooling water is attached to the engine body 1. The output voltages of the sensors 37 and 38 are input to the input port 35 via corresponding AD converters 39, respectively. The input port 35 is connected to a crank angle sensor 40, which generates a pulse whenever a crankshaft is turned by, for example, 30 degrees. The CPU 34 calculates the intake air amount according to the output voltages from the pressure sensor 37, and calculates the engine speed N according to the pulses from the crank angle sensor 40. The output port 36 is connected to the spark plugs 4 and the fuel injectors 11 via corresponding drive circuits 41, respectively.

Figure 2:
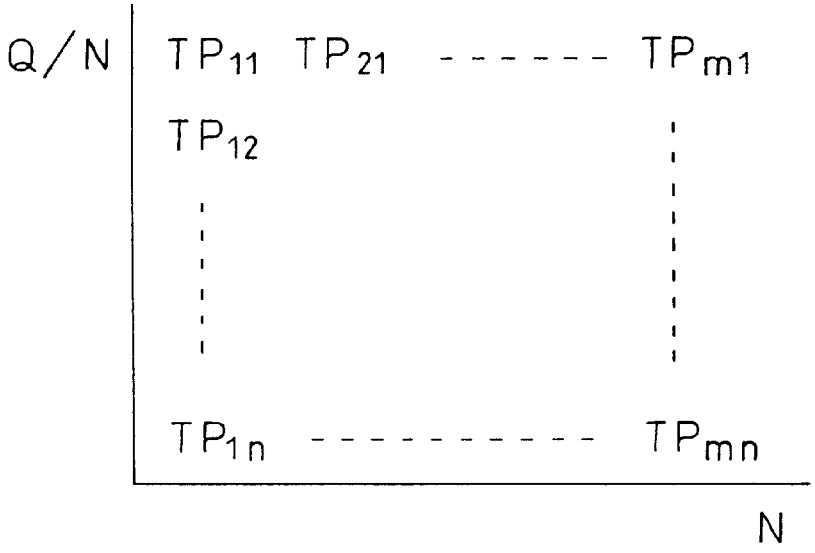
FIG. 2 is a diagram illustrating the basic fuel injection time.

In the engine shown in FIG. 1, the fuel injection time TAU is calculated on the basis of the following equation, for example, that is:

$$TAU=TP\cdot K$$

where TP and K represent a basic fuel injection time and a correction coefficient, respectively. The basic fuel injection time TP is a fuel injection time required to make the air-fuel ratio of the air-fuel mixture to be fed to the combustion chamber 3 equal to the stoichiometric air-fuel ratio. The basic fuel injection time TP is obtained in advance by experiment, and is stored in the ROM 32 in advance as a function of the engine load Q/N (the intake air amount Q/the engine speed N), in the form of a map as shown in FIG. 2. The correction coefficient K is for controlling the air-fuel ratio of the air-fuel mixture to be fed to the combustion chamber 3. If K=1.0, the air-fuel of the air-fuel mixture to be fed to the combustion chamber 3 is made stoichiometric. If K<1.0, the air-fuel ratio is made larger than the stoichiometric air-fuel ratio, i.e., is made lean. If K>1.0, the air-fuel ratio is made smaller than the stoichiometric air-fuel ratio, i.e., is made rich. In the engine shown in FIG. 1, the correction coefficient K is usually made smaller than 1.0, such as 0.6. Namely, the air-fuel ratio of the air-fuel mixture to be fed to the combustion chamber 3 is usually made lean, and thus the lean air-fuel mixture is usually burned in the combustion chamber 3.

Figure 3:
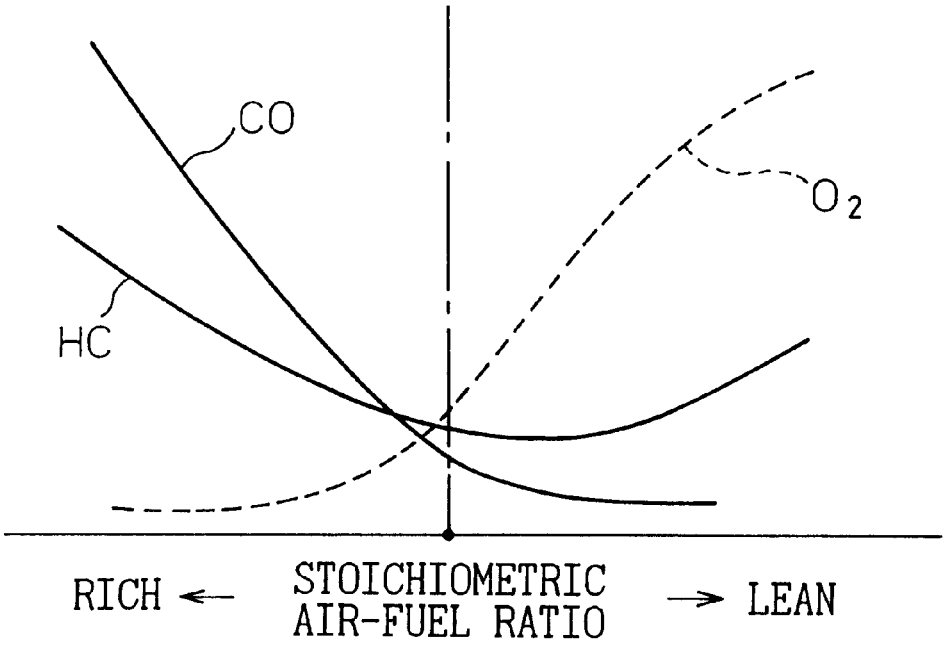
FIG. 3 is a diagram schematically illustrating the concentration of the unburned HC, CO, and oxygen in the exhaust gas from the engine.

FIG. 3 schematically illustrates the concentration of the representative component in the exhaust gas discharged from the combustion chamber 3. As can be seen from FIG. 3, the amount of the unburned HC and CO in the exhaust gas from the combustion chamber 3 becomes larger as the air-fuel ratio of the air-fuel mixture to be fed to the engine becomes richer, and the amount of oxygen $O_2$ in the exhaust gas from the combustion chamber 3 becomes larger as the air-fuel ratio of the air-fuel mixture to be fed to the engine becomes leaner.

The $NO_X$ absorbent 16 housed in the casing 17 is comprised of at least one substance selected from alkali metals such as potassium K, sodium Na, lithium Li, and cesium Cs, alkali earth metals such as barium Ba and calcium Ca, rare earth metals such as lanthanum La and yttrium Y, and of precious metals such platinum Pt, which are carried on a carrier such as alumina. The $NO_X$ absorbent 16 performs $NO_X$ absorbing and releasing functions in which the $NO_X$ absorbent 16 absorbs $NO_X$ therein when the air-fuel ratio of the inflowing exhaust gas is lean, and releases the absorbed $NO_X$ therefrom when the oxygen concentration in the inflowing exhaust gas becomes lower. Note that, in a case where no fuel or air is fed to the exhaust passage upstream of the $NO_X$ absorbent 16, the air-fuel ratio of the exhaust gas flowing to the $NO_X$ absorbent 16 conforms to that of the air-fuel mixture to be fed to the combustion chamber 3. Accordingly, the $NO_X$ absorbent 16 absorbs $NO_X$ therein when the air-fuel ratio of the air-fuel mixture to be fed to the combustion chamber 3 is lean, and releases the absorbed $NO_X$ when the oxygen concentration in the air-fuel mixture to be fed to the combustion chamber 3 becomes lower.

When the $NO_X$ absorbent 16 is disposed in the exhaust passage of the engine, the $NO_X$ absorbent 16 actually performs the $NO_X$ absorbing and releasing function, but the function is unclear. However, it is considered that the function is performed according to the mechanism shown in FIGS. 4A and 4B. This mechanism will be explained by using as an example the case where platinum Pt and barium Ba are carried on the carrier, but a similar mechanism is obtained even if another precious metal, alkali metal, alkali earth metal, or rare earth metal is used.

Figure 4A:
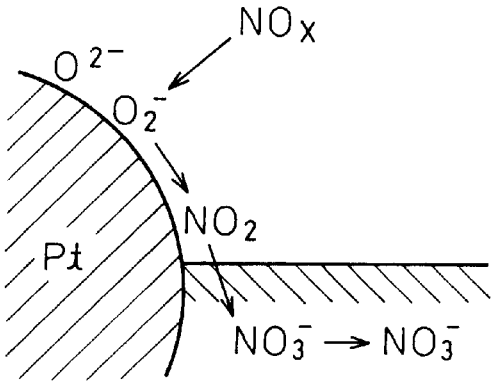
FIGS. 4A and 4B illustrate the $NO_X$ absorbing and releasing function of the $NO_X$ absorbent.

Namely, when the inflowing exhaust gas becomes considerably lean, the oxygen concentration in the inflowing exhaust gas greatly increases, and as shown in FIG. 4A, oxygen $O_2$ is deposited on the surface of the platinum Pt in the form of $O_2^-$ or $O^{2-}$. On the other hand, NO in the inflowing exhaust gas reacts with the $O_2^-$ or $O^{2-}$ on the surface of the platinum Pt and becomes $NO_2$ ($2NO+O_2 \rightarrow 2NO_2$). Subsequently, a part of the produced $NO_2$ is oxidized on the platinum Pt and is absorbed into the absorbent. While bonding with barium oxide BaO, it is diffused in the absorbent in the form of nitric acid ions $NO_3^-$, as shown in FIG. 4A. In this way, $NO_X$ is absorbed in the $NO_X$ absorbent 16.

As long as the oxygen concentration in the inflowing exhaust gas is high, $NO_2$ is produced on the surface of the platinum Pt, and as long as the $NO_X$ absorbing capacity of the absorbent is not saturated, $NO_2$ is absorbed in the absorbent and the nitric acid ions $N_3^-$ are produced. Contrarily, when the oxygen concentration in the inflowing exhaust gas becomes lower and the production of $NO_2$ is lowered, the reaction proceeds in an inverse direction ($NO_3^- \rightarrow NO_2$), and thus nitric acid ions $NO_3^-$ in the absorbent is released in the form of $NO_2$ from the absorbent. Namely, when the oxygen concentration in the inflowing exhaust gas becomes lower, $NO_X$ is released from the $NO_X$ absorbent 16. As shown in FIG. 3, when the degree of leanness of the inflowing exhaust gas becomes low, the oxygen concentration in the inflowing exhaust gas is lowered, and thus $NO_X$ is released from the $NO_X$ absorbent 16 when the degree of leanness of the inflowing exhaust gas is lowered.

Figure 4B:
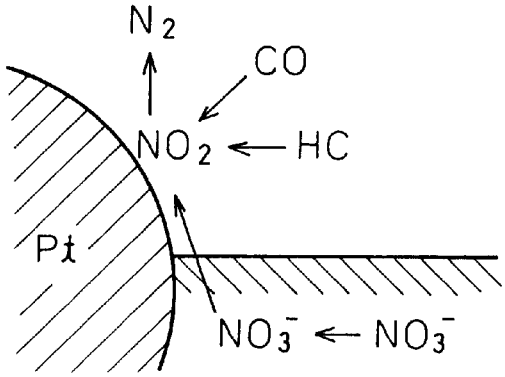

On the other hand, if the air-fuel ratio of the inflowing exhaust gas is made rich at this time, a large amount of unburned HC and CO are discharged from the engine, as shown in FIG. 3. The unburned HC and the CO react with oxygen $O_2^-$ or $O^{2-}$ on the surface of platinum Pt, and are oxidized. Also, when the air-fuel ratio of the inflowing exhaust gas is made rich, the oxygen concentration in the inflowing exhaust gas is extremely lowered. Thus, $NO_2$ is released from the absorbent and the $NO_2$ reacts with unburned HC and CO and is reduced as shown in FIG. 4B. In this way, when no $NO_2$ exists on the surface of platinum Pt, $NO_2$ is released from the absorbent successively. Therefore, when the air-fuel ratio of the inflowing exhaust gas is rich, $NO_X$ is released from the $NO_X$ absorbent 16 in a short time.

In this way, $NO_X$ is absorbed in the $NO_X$ absorbent 16 when the air-fuel ratio of the inflowing exhaust gas is lean, and $NO_X$ is released from the $NO_X$ absorbent 16 in a short time when the air-fuel ratio of the inflowing exhaust gas is rich. Therefore, in the engine shown in FIG. 1, when an amount of $NO_X$ absorbed in the $NO_X$ absorbent 16 becomes larger than a constant amount, the air-fuel ratio of the air-fuel mixture fed to the combustion chamber 3 is made temporarily rich to release $NO_X$ from the $NO_X$ absorbent 16 and to reduce the $NO_X$.

However, the exhaust gas contains sulphur containing components, and thus the $NO_X$ absorbent absorbs not only $NO_X$, but also sulphur containing components such as $SO_X$. It is considered that the absorption mechanism of $SO_X$ into the $NO_X$ absorbent 16 is same as that of $NO_X$.

Namely, when explaining the mechanism by taking an example in which platinum Pt and barium Ba are carried on the carrier, as in the explanation of the $NO_X$ absorption mechanism, oxygen $O_2$ is deposited on the surface of platinum Pt, in the form of $O_2^-$ or $O^{2-}$, when the air-fuel ratio of the inflowing exhaust gas is lean, as mentioned above. $SO_X$, such as $SO_2$, in the inflowing exhaust gas reacts with $O_2^-$ or $O^{2-}$ on the surface of platinum Pt and becomes $SO_3$. The produced $SO_3$ is then further oxidized on the platinum Pt and is absorbed into the absorbent. While bonding with barium oxide BaO, it is diffused in the absorbent in the form of sulphuric acid ions $SO_4^{2-}$. The sulphuric acid ions $SO_4^{2-}$ bond with barium ions $Ba^{2+}$ to produce sulphate $BaSO_4$.

However, the sulphate $BaSO_4$ is difficult to decompose and, if the air-fuel ratio of the inflowing exhaust gas is simply made rich, the sulphate $BaSO_4$ remains as it is without being decomposed. Accordingly, as the time is elapsed, the amount of the sulphate $BaSO_4$ in the $NO_X$ absorbent 16 increases, and thus the amount of $NO_X$ that can be absorbed in the $NO_X$ absorbent 16 will be lowered.

However, when the temperature of the $NO_X$ absorbent 16 is higher than the $SO_X$ releasing temperature of the $NO_X$ absorbent 16, the sulphate $BaSO_4$ produced in the $NO_X$ absorbent 16 can be decomposed by making the air-fuel ratio of the inflowing exhaust gas rich or stoichiometric, and thus the sulphuric acid ions $SO_4^{2-}$ are released from the absorbent in the form of $SO_3$. Therefore, in the present embodiment, the air-fuel ratio of the exhaust gas flowing to the $NO_X$ absorbent 16 is made rich or stoichiometric temporarily when the temperature of the $NO_X$ absorbent 16 is higher than the $SO_X$ releasing temperature, to thereby release $SO_X$ from the $NO_X$ absorbent 16. The released $SO_3$ is reduced to $SO_2$ immediately by the unburned HC and CO in the inflowing exhaust gas.

In this way, in the present embodiment, the sulphurous component absorbent is formed by the $NO_X$ absorbent 16. Note that it is decided whether the air-fuel ratio of the exhaust gas flowing to the $NO_X$ absorbent 16 is made rich or stoichiometric when $SO_X$ should be released from the $NO_X$ absorbent 16, on the basis of an amount of $SO_X$ to be released from the $NO_X$ absorbent 16 per unit time.

In a case where no heating device, such as an electric heater, is provided for heating the exhaust gas flowing to the $NO_X$ absorbent 16 or the $NO_X$ absorbent 16 directly, as in the engine shown in FIG. 1, the temperature of the $NO_X$ absorbent 16 becomes higher than the $SO_X$ releasing temperature when the engine load is high. However, when the engine load is high, the flow rate of the exhaust gas flowing through the $NO_X$ absorbent 16 is high, and the contact period between the exhaust gas and the $NO_X$ absorbent 16 is short when the engine load is high. However, the $SO_X$ releasing rate of the $NO_X$ absorbent 16 is relatively low, and thus $SO_X$ is not released from the $NO_X$ absorbent sufficiently, even when the air-fuel ratio of the inflowing exhaust gas is made rich, with a condition where the contact period is short. Namely, the air-fuel ratio of the exhaust gas flowing to the $NO_X$ absorbent 16 must be made rich for a long time, or the degree of richness of the exhaust gas flowing to the $NO_X$ absorbent must be larger, to release $SO_X$ from the $NO_X$ absorbent 16 sufficiently, if the contact period is short.

Therefore, in the engine shown in FIG. 1, the air-fuel ratio of the exhaust gas flowing to the $NO_X$ absorbent 16 is made rich temporarily to thereby release $S_X$ from the $NO_X$ absorbent 16, when the flow rate SVN of the exhaust gas flowing through the $NO_X$ absorbent 16 is lower than a predetermined flow rate SVN1, i.e., when the contact period between the exhaust gas and the $NO_X$ absorbent 16 is longer than a period required to release $SO_X$ from the $NO_X$ absorbent 16 sufficiently. In other words, the air-fuel ratio of the exhaust gas flowing to the $NO_X$ absorbent 16 is temporarily made rich when the temperature of the $NO_X$ absorbent 16 is higher than the $S_X$ releasing temperature and the flow rate SVN is lower than the predetermined flow rate SVN1. When the flow rate of the exhaust gas flowing through the $NO_X$ absorbent 16 becomes lower, the contact period between the exhaust passage and the $NO_X$ absorbent 16 becomes longer, and thus the residence time of the exhaust gas in the $NO_X$ absorbent 16 becomes longer. Thus, the exhaust gas is effectively used for releasing $SO_X$. As a result, a period during which the air-fuel ratio of the exhaust gas flowing to the $NO_X$ absorbent 16 must be made rich can be made shorter, or the degree of richness of the exhaust gas flowing to the $NO_X$ absorbent 16 is kept lower. Note that the temperature of the $NO_X$ absorbent 16 is higher than the $SO_X$ releasing temperature and the flow rate SVN is lower than the predetermined flow rate SVN1, at the engine low load operation just after the engine high load operation, for example.

The inventors of the present invention have found that the sulphate $BaSO_4$ decomposes relatively easily and is released from the $NO_X$ absorbent 16 if the exhaust gas in the $NO_X$ absorbent 16 contains CO or $H_2$, and that it is released more easily as the amount of CO or $H_2$ becomes larger. On the other hand, the exhaust gas which is obtained when the rich air-fuel mixture is burned with the flow rate being low, contains CO and unburned HC of high concentration, as shown in Table 1, and CO and $H_2$ are produced by oxidation of the unburned HC by oxygen $O_2$ and $NO_X$. Namely, the concentration of CO and $H_2$ in the $NO_X$ absorbent 16 is relatively high when the rich air-fuel mixture is burned with the flow rate of the exhaust gas is low. This is due to the following reasons. When the flow rate of the exhaust gas is high, the exhaust gas discharged from the combustion chamber 3 flows through the exhaust passage upstream of the $NO_X$ absorbent 16 while the temperature thereof is kept high. Thus, the oxidizing reaction of CO and unburned HC occurs in the exhaust passage upstream of the $NO_X$ absorbent 16, and therefore the concentration of CO and unburned HC in the exhaust gas flowing to the $NO_X$ absorbent 16 is lowered. Contrarily, when the flow rate is low, the temperature of the exhaust gas drops quickly when it is discharged from the combustion chamber 3. Thus, the unburned HC and CO reach the $NO_X$ absorbent 16 without being oxidized. Namely, the exhaust gas flows into the $NO_X$ absorbent 16, while the concentration of the unburned HC and CO is kept high. Therefore, in the engine shown in FIG. 1, the air-fuel ratio of the air-fuel mixture to be fed to the combustion chamber 3 is made rich, and the air-fuel mixture is ignited by the spark plug 4 and is burned, when the air-fuel ratio of the exhaust gas flowing to the $NO_X$ absorbent 16 must be made rich. Further, the rich air-fuel mixture is burned with the flow rate of the exhaust gas being low, when $SO_X$ must be released from the $NO_X$ absorbent 16.

TABLE 1

| | Concentration at inlet of $NO_X$ Absorbent | | |
|---|---|---|---|
| | Unburned HC (ppm) | CO (%) | $CO_2$ (%) |
| Flow Rate of Exhaust Gas | | | |
| High | 1,850 | 1.7 | 13.76 |
| Low | 3,800 | 2.2 | 13.44 |

Note that, in Table 1, the engine speed is 2,800 r.p.m. and the air-fuel ratio of the air-fuel mixture burned in the combustion chamber 3 is 13.0, in each case.

On the other hand, the air-fuel ratio of the exhaust gas flowing to the $NO_X$ absorbent 16 can be made rich by secondarily feeding fuel (gasoline), for example, to the exhaust manifold 15 while the lean air-fuel ratio is burned. However, in this case, the fuel flowing to the $NO_X$ absorbent 16 is a higher hydrocarbon of which the molecular weight is large, and thus CO and $H_2$ are not produced easily. Contrarily, when the rich air-fuel mixture is burned, the unburned HC flowing to the $NO_X$ absorbent 16 is a lower hydrocarbon of which the molecular weight is small, i.e., a hydrocarbon which is partially oxidized, and thus CO and $H_2$ are produced easily. Therefore, the combustion of the rich air-fuel mixture is preferable to the secondary feeding of fuel to the exhaust manifold 15, to release the absorbed $SO_X$ from the $NO_X$ absorbent 16 sufficiently. Thus, in the engine shown in FIG. 1, the rich air-fuel mixture is burned to make the air-fuel ratio of the exhaust gas flowing to the $NO_X$ absorbent 16.

Figure 12:
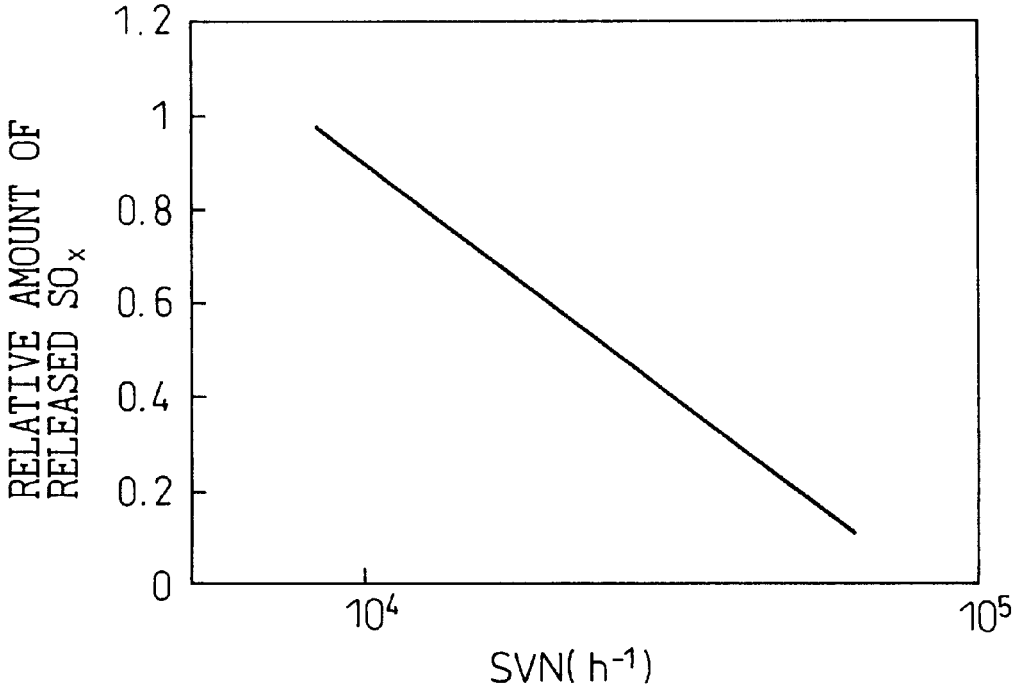
FIG. 12 is a diagram illustrating relationships between the amount of $SO_X$ released from the $NO_X$ absorbent and the flow rate.
Figure 13:
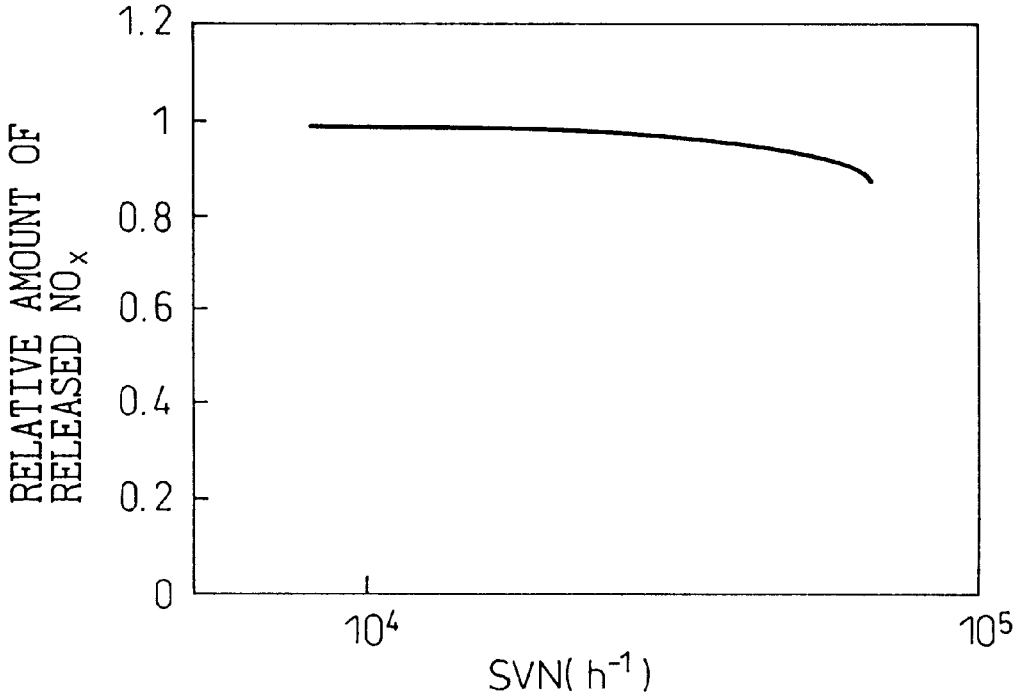
FIG. 13 is a diagram illustrating relationships between the amount of $NO_X$ released from the $NO_X$ absorbent and the flow rate.

FIG. 12 illustrates experimental results showing the relationships between the flow rate SVN and the amount of $SO_X$ released from the $NO_X$ absorbent 16, and FIG. 13 illustrates experimental results showing the relationships between the flow rate SVN and the amount of $NO_X$ released from the $NO_X$ absorbent 16. In FIGS. 12 and 13, the $SO_X$ amount and the $NO_X$ amount when SVN=10,000 ($h^{-1}$) are made 1.0, respectively. As can be seen from FIG. 12, the amount of $SO_X$ released from the $NO_X$ absorbent 16 becomes larger, when the flow rate SVN becomes lower. Contrarily, as shown in FIG. 13, the amount of $NO_X$ released from the $NO_X$ absorbent 16 does not vary widely, even though the flow rate SVN varies. This is because the decomposition rate of nitrate is sufficiently high. In other words, the decomposition rate of sulphate considerably low, and thus the released $SO_X$ amount becomes low when the flow rate of the exhaust gas becomes high.

Next, the control of the $SO_X$ releasing operation in the engine shown in FIG. 1 will be explained, in more detail, with reference to FIG. 5. The routine shown in FIG. 5 is executed by interruption every predetermined time.

Figure 5:
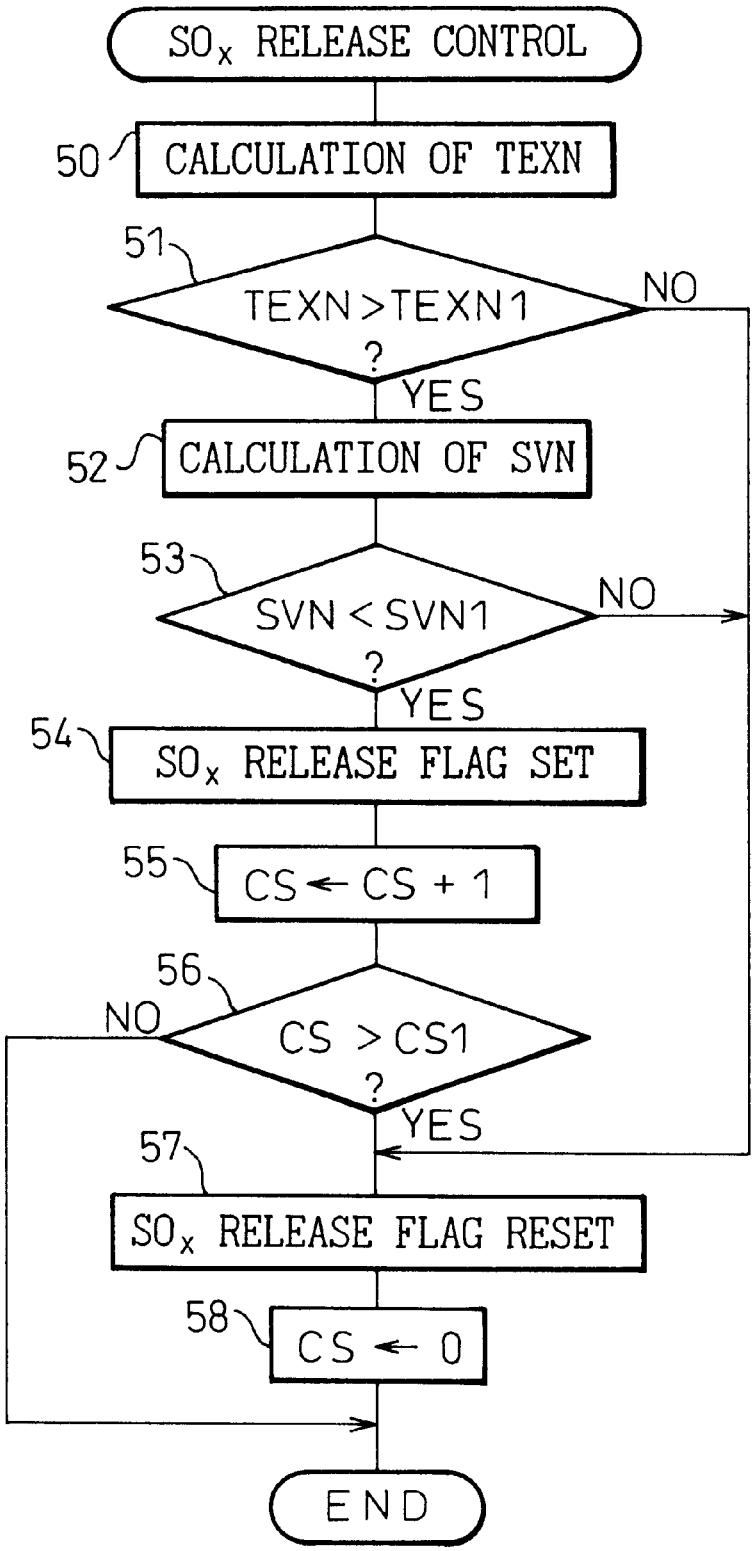
FIG. 5 shows a flowchart for controlling the $SO_X$ releasing operation.
Figure 6:
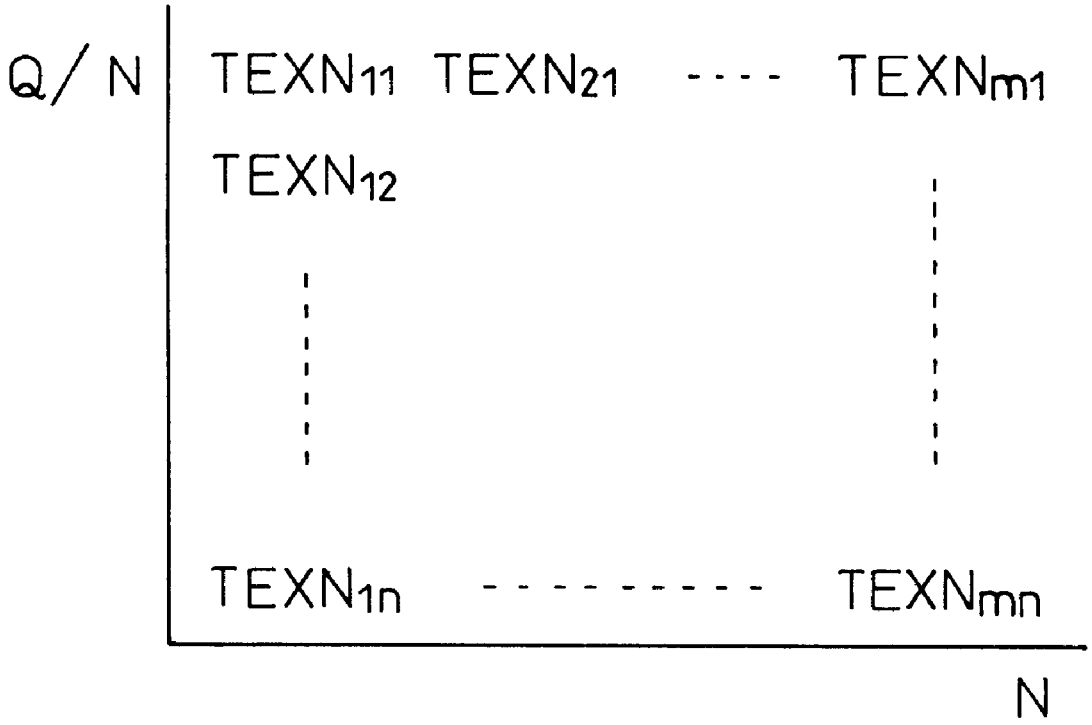
FIG. 6 is a diagram illustrating the $NO_X$ absorbent temperature TEXN.

Referring to FIG. 5, first, in step 50, the temperature TEXN of the exhaust gas flowing to the $NO_X$ absorbent 16 is calculated using the map shown in FIG. 6. The temperature TEXN represents the temperature of the $NO_X$ absorbent 16, and thus TEXN is referred to as a $NO_X$ absorbent temperature, hereinafter. To obtain the $NO_X$ absorbent temperature TEXN, a temperature sensor may be arranged in the inlet of the $NO_X$ absorbent 16, but TEXN can be obtained on the basis of the engine operating condition. Thus, in the engine shown in FIG. 1, the $NO_X$ absorbent temperature TEXN is obtained by experiment in advance, as a function of the engine load Q/N and the engine speed N, and is calculated on the basis of the engine load Q/N and the engine speed N. The $NO_X$ absorbent temperature TEXN is stored in the ROM 32 in advance in the form of the map shown in FIG. 6.

Figure 7A:
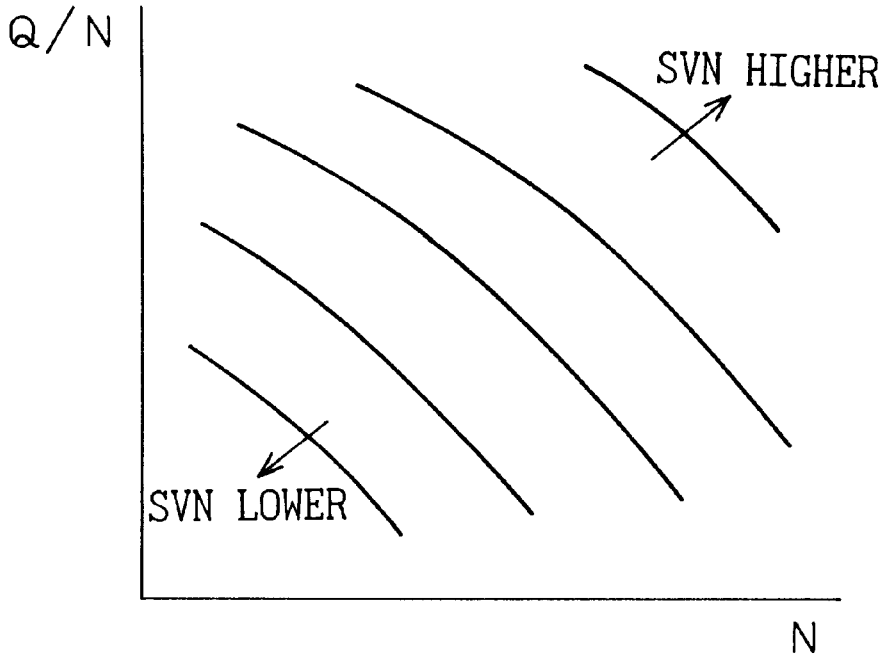
FIGS. 7A and 7B are diagrams illustrating the flow rate SVN.
Figure 7B:
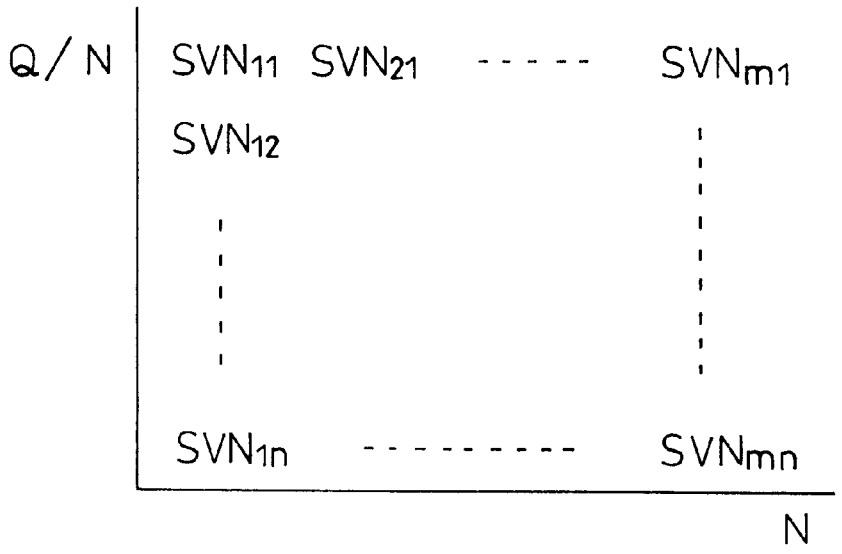

In the following step 51, it is judged whether the $NO_X$ absorbent temperature TEXN is higher than the $SO_X$ releasing temperature TEXN1 of the $NO_X$ absorbent 16, such as 500° C. When TEXN>TEXN1, the routine goes to step 52, where the flow rate SVN of the exhaust gas flowing through the $NO_X$ absorbent 16. To obtain the flow rate SVN, a flow rate sensor may be arranged in the inlet of the $NO_X$ absorbent 16, but SVN can be obtained on the basis of the engine operating condition. Namely, as shown in FIG. 7A in which each curve shows the identical flow rate, the flow rate SVN becomes higher as the engine load Q/N becomes higher, and becomes higher as the engine speed N becomes higher. Thus, in the engine shown in FIG. 1, the flow rate SVN is obtained by experiment in advance, as a function of the engine load Q/N and the engine speed N, and is calculated on the basis of the engine load Q/N and the engine speed N. The flow rate SVN is stored in the ROM 32, in advance, in the form of the map shown in FIG. 7B.

In the following step 53, it is judged whether the flow rate SVN is higher than the predetermined flow rate SVN1, i.e., whether the contact period between the exhaust gas and the $NO_X$ absorbent 16 is longer than a period required to release $SO_X$ from the $NO_X$ absorbent 16 sufficiently. When SVN<SVN1, it is judged that the contact period is enough long for the good $SO_X$ releasing operation, and the routine goes to step 54, where a $SO_X$ release flag is set. The $SO_X$ release flag is set when $SO_X$ is released from the $NO_X$ absorbent 16, and is reset when the $SO_X$ releasing operation is not in process. Namely, when TEXN>TEXN1 and SVN<SVN1, the $SO_X$ release flag is set. When the $SO_X$ flag is set, the air-fuel ratio of the air-fuel mixture to be burned in the combustion chamber 3 is made rich, as explained later. In the following step 55, the counter value CS, which represents a time during which the $SO_X$ releasing operation is in process, is incremented by 1. In the following step 56, it is judged whether the counter value CS is larger than a constant CS1, i.e., whether the $SO_X$ releasing operation is performed for a constant time. When CS≦CS1, the processing cycle is ended.

Contrarily, when CS>CS1, i.e., when the $SO_X$ releasing operation is performed for the constant time, the routine goes to step 57, where the $SO_X$ release flag is reset. In the following step 58, the counter value CS is cleared. Then, the processing cycle is ended.

Contrarily, when TEXN≦TEXN1 in step 51, or when SVN≧SVN1 in step 53, the routine goes to step 57, where the $SO_X$ release flag is reset. Thus, the $SO_X$ releasing operation is stopped.

Next, the control of the $NO_X$ releasing operation in the engine shown in FIG. 1 will be explained in more detail, with reference to FIG. 8. The routine shown in FIG. 8 is executed by interruption every predetermined time.

Figure 8:
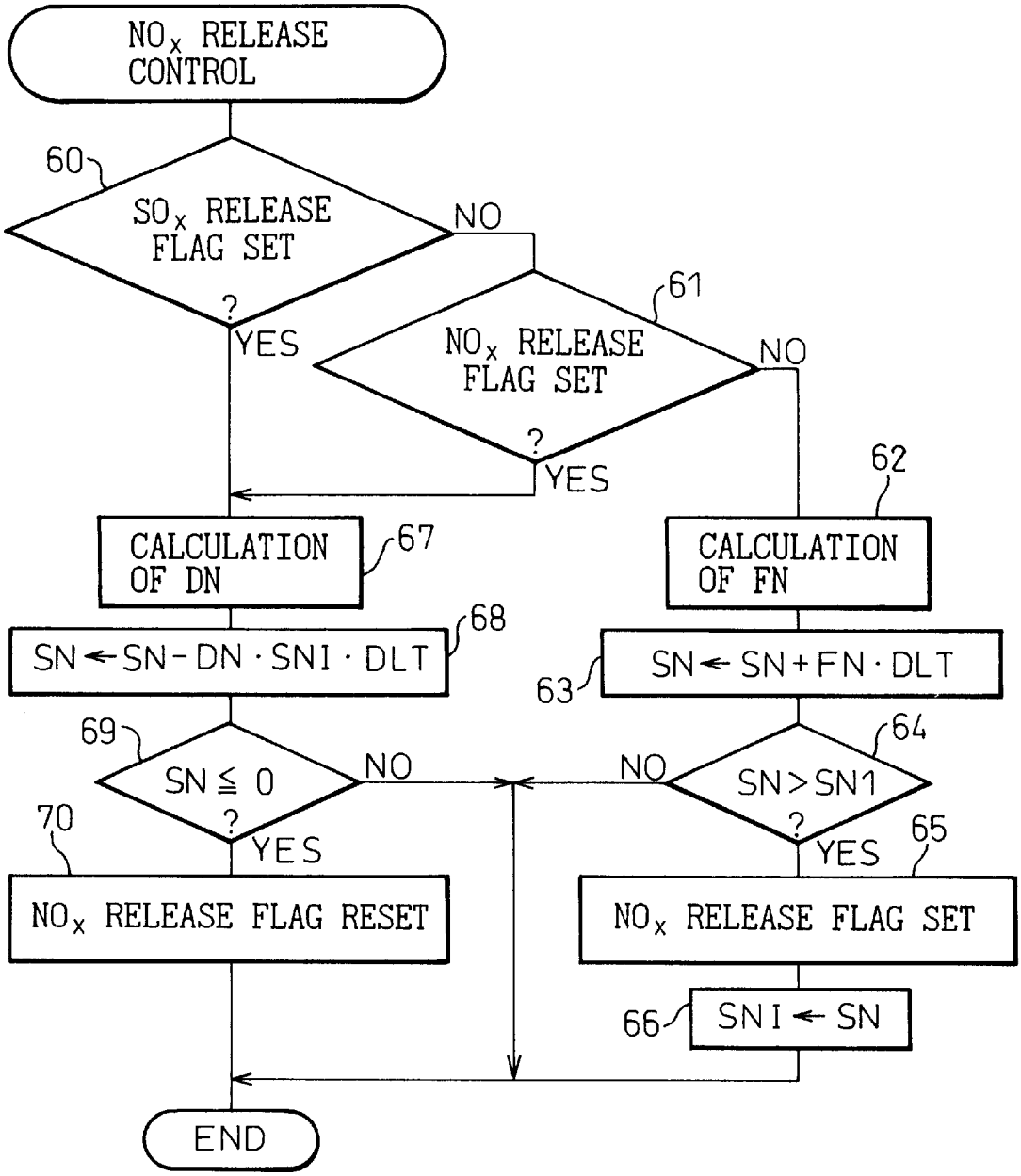
FIG. 8 shows a flowchart for controlling the $NO_X$ releasing operation.

Referring to FIG. 8, first, in step 60, it is judged whether the $SO_X$ release flag, which is set or reset in the routine shown in FIG. 5, is set. When the $SO_X$ release flag is reset, the routine goes to step 61, where it is judged whether a $NO_X$ release flag is set. The $NO_X$ release flag is set when $NO_X$ is released from the $NO_X$ absorbent 16 and is reduced, and is reset when the $NO_X$ releasing operation is not in process. When the $NO_X$ release flag is reset, i.e., when both of the $SO_X$ release flag and the $NO_X$ release flag are reset, the routine goes to step 62. When both of the $SO_X$ release flag and the $NO_X$ release flag are reset, the air-fuel ratio of the exhaust gas flowing to the $NO_X$ absorbent 16 is made lean, as explained later, and thus the $NO_X$ absorbing operation is in process in the $NO_X$ absorbent 16.

Figure 9A:
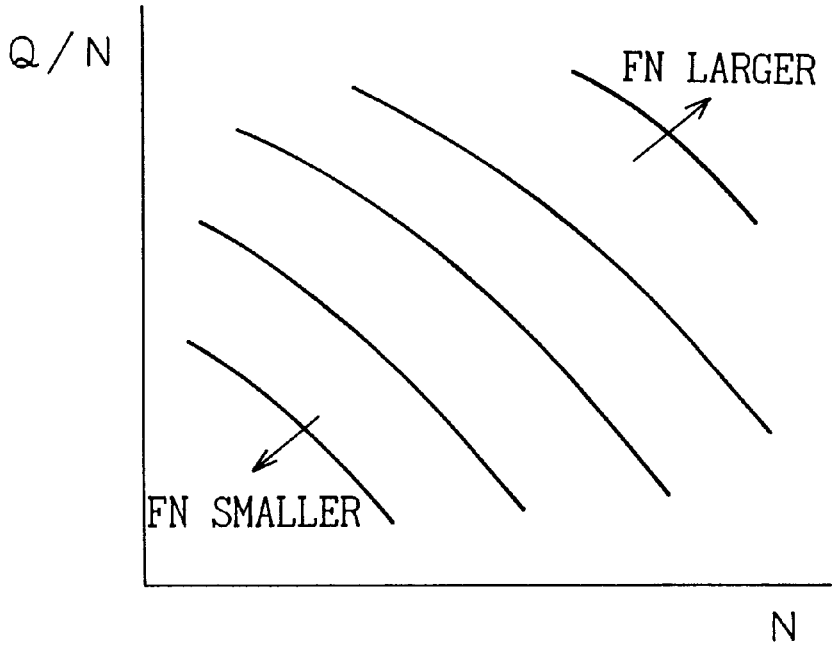
FIGS. 9A and 9B are diagrams illustrating the inflowing $NO_X$ amount FN.
Figure 9B:
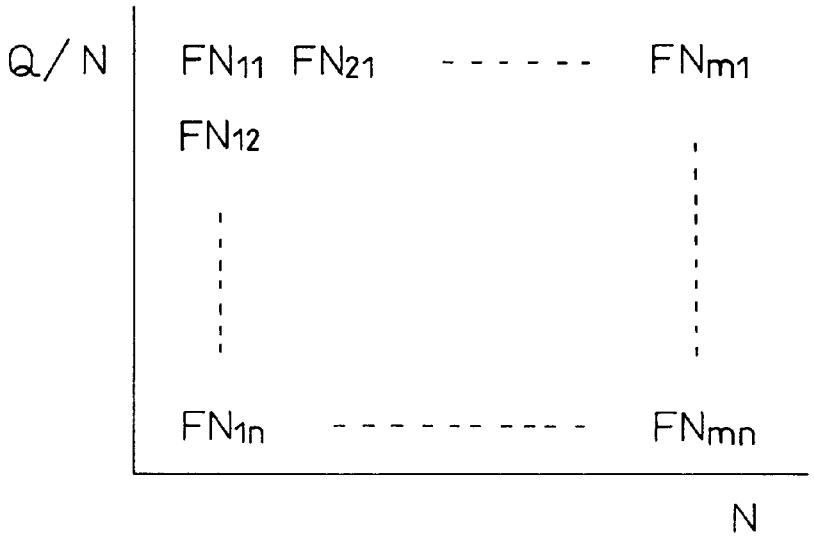

The steps 62 and 63 are for obtaining the amount SN of $NO_X$ absorbed in the $NO_X$ absorbent 16. It is difficult to obtain the absorbed $NO_X$ amount SN directly, and thus the absorbed $NO_X$ amount SN is estimated on the basis of the amount of $NO_X$ discharged from the engine 1, i.e., the engine operating condition, in the engine shown in FIG. 1. Namely, in step 62, an amount FN of $NO_X$ flowing to the $NO_X$ absorbent 16 per unit time is calculated. As shown in FIG. 9A in which each curve shows the identical inflowing $NO_X$ amount, the inflowing $NO_X$ amount FN becomes larger as the engine load Q/N becomes higher, and becomes larger as the engine speed N becomes higher. Thus, in the engine shown in FIG. 1, the inflowing $NO_X$ amount FN is obtained, by experiment in advance, as a function of the engine load Q/N and the engine speed N, and is calculated on the basis of the engine load Q/N and the engine speed N. The inf lowing $NO_X$ amount FN is stored in the ROM 32 in advance in the form of the map shown in FIG. 9B. In the following step 63, the absorbed $NO_X$ amount SN is calculated on the basis of the following equation.

$$SN=SN+FN\cdot DLT$$

where DLT represents a period from the last processing cycle to the present processing cycle, and thus the FN·DLT represents the amount of $NO_X$ absorbed in the $NO_X$ amount from the last processing cycle to the present processing cycle. In the following step 64, it is judged whether the absorbed $NO_X$ amount SN is larger than a predetermined amount SN1. The predetermined amount SN1 corresponds to about 30% of the maximum $NO_X$ amount which the $NO_X$ absorbent 16 can absorb therein, for example. When SN≦SN1, the processing cycle is ended. When SN>SN1, the routine goes to step 65, where the $NO_X$ release flag is set. In the following step 66, the absorbed $NO_X$ amount SN, when the $NO_X$ release flag is set, is memorized as an initial absorbed amount SNI.

When the $NO_X$ release flag is set, the routine goes from step 61 to step 67. When the $NO_X$ release flag is set, the air-fuel ratio of the exhaust gas flowing to the $NO_X$ absorbent 16 is made rich, as explained later, and thus the $NO_X$ releasing operation is in process in the $NO_X$ absorbent 16. In step 67, the amount DN of $NO_X$ released from the $NO_X$ absorbent 16 per unit initial absorbed $NO_X$ amount and per unit time is calculated.

Figure 10A:
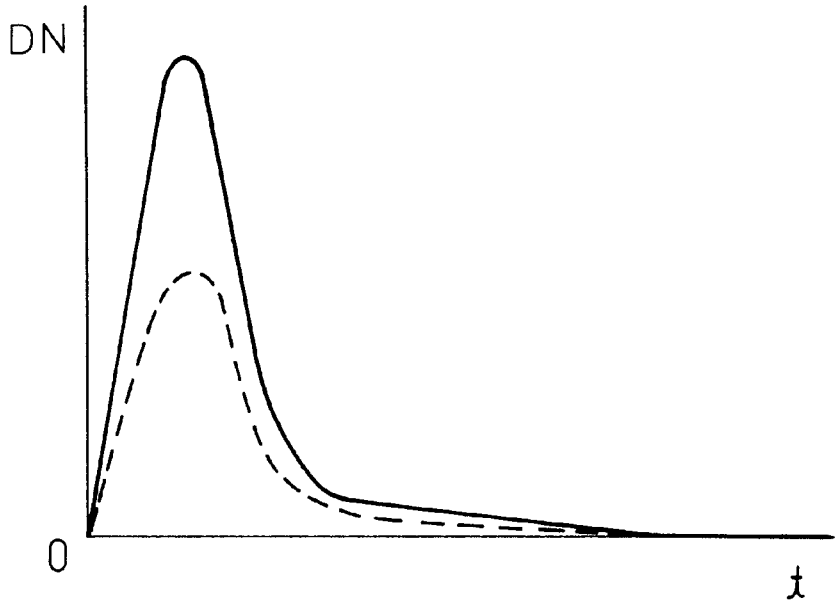
FIGS. 10A and 10B are diagrams illustrating the released $NO_X$ amount DN.
Figure 10B:
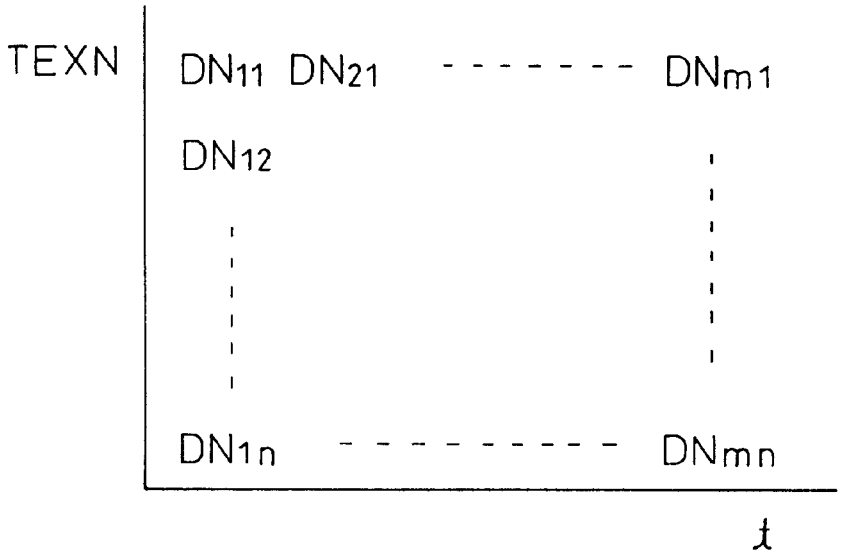

FIGS. 10A and 10B illustrate experimental results showing the amount of $NO_X$ released from the $NO_X$ absorbent 16 per unit time and per unit initial absorbed $NO_X$ amount, when the air-fuel ratio of the exhaust gas flowing to the $NO_X$ absorbent 16 is made rich. In FIG. 10A, the solid line represents the case where the $NO_X$ absorbent temperature TEXN is high, and the dotted line represents the case where the $NO_X$ absorbent temperature TEXN is low. Further, in FIG. 10A, t represents a time from when the air-fuel ratio of the exhaust gas flowing to the $NO_X$ absorbent 16 is made rich. When the $NO_X$ absorbent temperature TEXN becomes high, the decomposition rate of nitrate in the $NO_X$ absorbent 16 becomes high. Thus, as shown in FIG. 10A, the released $NO_X$ amount DN becomes larger as the $NO_X$ absorbent temperature TEXN becomes higher. The released $NO_X$ amount DN is stored in the ROM 32 in advance as a function of the $NO_X$ absorbent temperature TEXN and the time t, in the form of a map shown in FIG. 10B. In the following step 68, the absorbed $NO_X$ amount SN is calculated on the basis of the following equation.

$$SN=SN-DN\cdot SNI\cdot DLT$$

where DN·SNI represents an amount of $NO_X$ released from the $NO_X$ absorbent 16 per unit time, and DN·SNI·DLT represents an amount of $NO_X$ released from the $NO_X$ absorbent 16 from the last processing cycle to the present processing cycle. In the following step 69, it is judged whether the absorbed $NO_X$ amount is smaller or equal to zero. When SN>0, the processing cycle is ended. When SN≦0, the routine goes to step 70, the $NO_X$ release flag is reset.

Contrarily, when the $SO_X$ release flag is set, the routine goes from step 60 to step 67. When the $SO_X$ release flag is set, the air-fuel ratio of the exhaust gas flowing to the $NO_X$ absorbent 16 is made rich, as explained later, and thus the $SO_X$ releasing operation is in process together with the $NO_X$ releasing process, in the $NO_X$ absorbent 16.

Figure 11:
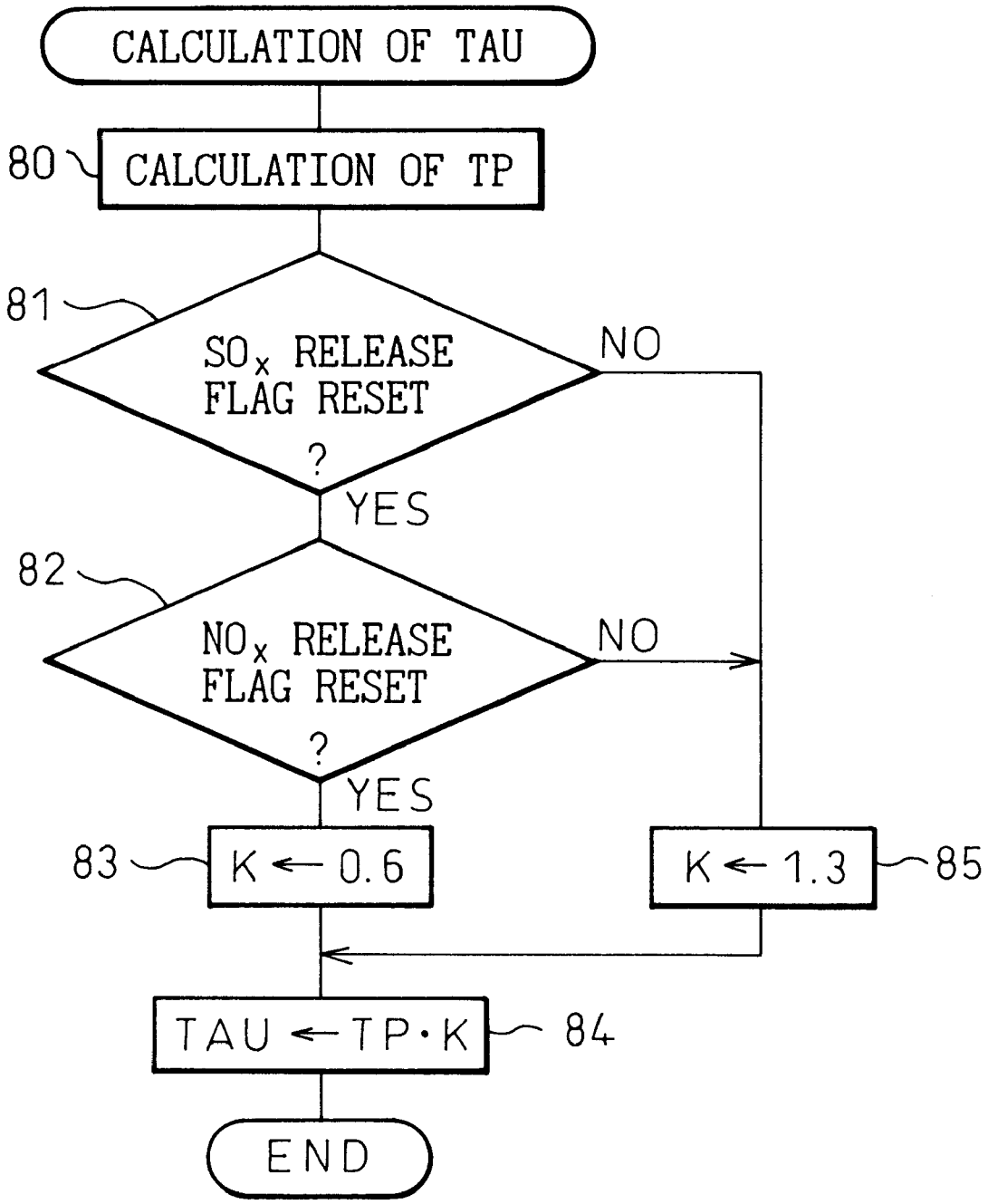
FIG. 11 shows a flowchart for calculating the fuel injection time TAU.

FIG. 11 shows a routine for calculating the fuel injection time TAU. The routine is executed by interruption every predetermined crank angle.

Referring to FIG. 11, first, in step 80, the basic fuel injection time TP is calculated using the map shown in FIG. 2. In the following step 81, it is judged whether the $SO_X$ releasing flag is reset. When the $SO_X$ releasing flag is reset, the routine goes to step 83, where it is judged whether the $NO_X$ release flag is reset. When the $NO_X$ release flag is reset, the routine goes step 83, where the correction coefficient K is made 0.6, for example. In the following step 84, the fuel injection time TAU is calculated by multiplying K by TP.

Accordingly, the air-fuel mixture fed to the combustion chamber 3 at this time is made lean and the lean air-fuel mixture is burned, and thereby the air-fuel ratio of the exhaust gas flowing to the $NO_X$ absorbent 16 is made lean.

Contrarily, when the $SO_X$ release flag or the $NO_X$ release flag is set in step 81 or 82, the routine goes to step 85, where the correction coefficient K is made 1.3, for example, and then the routine goes to step 84. Accordingly, the air-fuel mixture fed to the combustion chamber 3 at this time is made rich and the rich air-fuel mixture is burned, and thereby the air-fuel ratio of the exhaust gas flowing to the $NO_X$ absorbent 16 is made rich.

Figure 14:
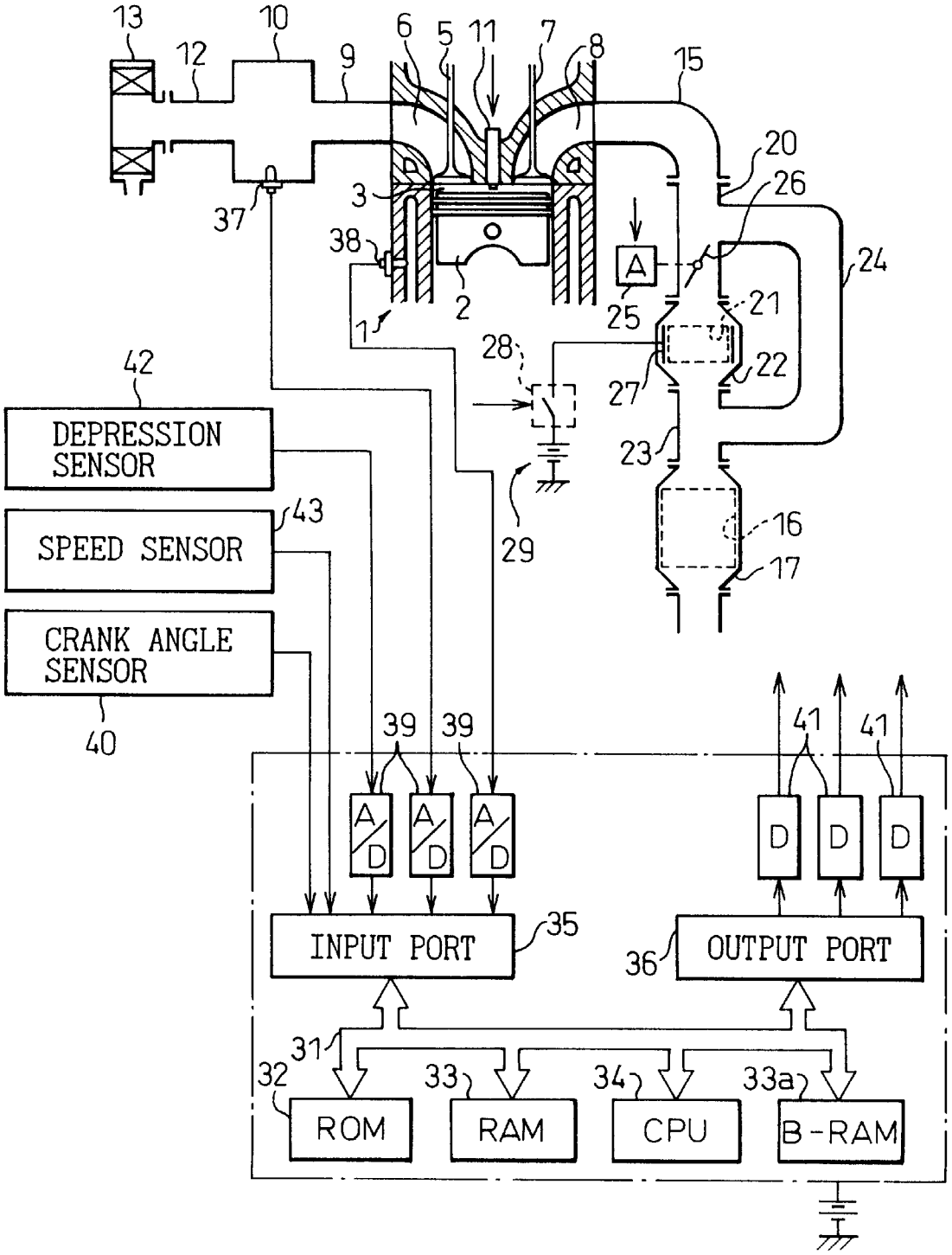
FIG. 14 is a general view of an engine according to another embodiment of the present invention.

FIG. 14 illustrates a case where the present invention is applied to the diesel engine. In FIG. 14, components similar to those in FIG. 1 are depicted by the same reference numerals.

Referring to FIG. 14, the fuel injector 11 is arranged in the combustion chamber 3, and injects fuel into the combustion chamber 3 directly. On the other hand, the exhaust manifold 15 is connected to a casing 22, housing a $SO_X$ absorbent 21 therein, via an exhaust pipe 20 and the casing 22 is connected to the casing 17, housing the $NO_X$ absorbent 16 therein, via an exhaust pipe 23. A bypass pipe 24 bypassing the $SO_X$ absorbent 21 is provided between the exhaust pipes 20 and 23. Further, an exhaust gas control valve 26 is arranged in the exhaust pipe 20 downstream of the inlet of the bypass pipe 24, and is driven by an actuator 25.

The exhaust gas control valve 26 is usually fully opened and thus almost all of the exhaust gas discharged from the engine flows to the $SO_X$ absorbent 21. Contrarily, when the valve 26 is closed, a part of the exhaust gas discharged from the engine flows to the bypass pipe 24, i.e., bypasses the $SO_X$ absorbent 21, and then flows to the $NO_X$ absorbent 16. The remaining exhaust gas flows to the $SO_X$ absorbent 21 and then to the $NO_X$ absorbent 16. Namely, when the valve 26 is closed, the amount of the exhaust gas flowing through the $SO_X$ absorbent 21 is reduced.

Referring further to FIG. 1, an electric heater 27 is attached to the $SO_X$ absorbent 21, and is electrically connected to a battery 29 via a relay 28. The relay 28 is usually turned off. When the relay 28 is turned on, the electric power is supplied to the heater 27 and thereby the $SO_X$ absorbent 21 is heated. Note that the actuator 25 and the relay 28 are controlled on the basis of the output signals from the ECU 30.

A depression sensor 42 generates an output voltage in proportion to the depression of the acceleration pedal (not shown), and the output voltages of the sensor 42 is input to the input port 35 of the ECU 30 via the corresponding AD converter 39. Further, the input port 35 is connected to a speed sensor 43, which generates a pulse representing the speed of the vehicle. The output port 36 is connected to the actuator 25 and the relay 28 via the corresponding drive circuits 41, respectively.

In the diesel engine as shown in FIG. 14, the mean air-fuel ratio of the air-fuel mixture to be burned in the combustion chamber 3 is usually kept lean, to reduce the undesirable smoke and particulate discharged from the engine. Thus, $NO_X$ discharged from the engine is usually absorbed in the $NO_X$ absorbent 16.

As mentioned above, it is not preferable that $SO_X$ is absorbed in the $NO_X$ absorbent 16. Thus, in the present embodiment, the $SO_X$ absorbent 21 is arranged in the exhaust passage upstream of the $NO_X$ absorbent 16 to prevent $SO_X$ from flowing to the $NO_X$ absorbent 16. The $SO_X$ absorbent 21 absorbs $SO_X$ therein when the air-fuel ratio of the inflowing exhaust gas is lean, and releases the absorbed $SO_X$ therefrom when the oxygen concentration in the inflowing exhaust gas becomes lower with the temperature of the $SO_X$ absorbent 21 being higher than a $SO_X$ releasing temperature of the $SO_X$ absorbent 21.

As mentioned above, if $SO_X$ is absorbed in the $NO_X$ absorbent 16, a stable sulphate $BaSO_4$ is formed, and as a result, the $SO_X$ is hardly released from the $NO_X$ absorbent 16, even when the air-fuel ratio of the exhaust gas flowing to the $NO_X$ absorbent 16 is simply made rich. Thus, to allow the $SO_X$ to be released from the $SO_X$ absorbent 21 easily when the air-fuel ratio of the exhaust gas flowing to the $SO_X$ absorbent 21 is made rich, it is necessary that the absorbed $SO_X$ exists in the absorbent in the form of the sulphuric acid ion $SO_4^{2-}$, or, even if the sulphate $BaSO_4$ is produced, the sulphate $BaSO_4$ exists in the absorbent in an unstable state. As the $SO_X$ absorbent 21 allowing this, an absorbent carrying at least one selected from lithium Li and a transition metal such as iron Fe, manganese Mn, nickel Ni, and tin Sn, on a carrier made of alumina, for example, can be used.

In the $SO_X$ absorbent 21, when the air-fuel ratio of the exhaust gas flowing to the $SO_X$ absorbent 21 is lean, $SO_X$ in the exhaust gas is oxidized on the surface of the absorbent and absorbed in the absorbent in the form of the sulphuric acid ion $SO_4^{2-}$, and then diffused in the absorbent. In this case, when platinum Pt is carried on the carrier of the $SO_X$ absorbent 21, $SO_X$ easily adheres to platinum Pt in the form of $SO_3^{2-}$, and thus $SO_2$ is easily absorbed in the absorbent in the form of the sulphuric acid ion $SO_4^{2-}$. Therefore, it is preferable to use the $SO_X$ absorbent 21 carrying platinum Pt to promote the absorption of the $SO_2$.

As mentioned above, the air-fuel ratio of the exhaust gas flowing into the $SO_X$ absorbent 21 is usually lean and thus $SO_X$ discharged from the engine is absorbed in the $SO_X$ absorbent 21 and only $NO_X$ is absorbed in the $NO_X$ absorbent 16.

However, the $SO_X$ absorbent 21 has a $SO_X$ absorbing capacity. Thus, it is necessary to release $SO_X$ from the $SO_X$ absorbent 21 before it is saturated with $SO_X$. In the present embodiment, the temperature of the $SO_X$ absorbent 21 is made higher than the $SO_X$ releasing temperature of the $SO_X$ absorbent 21 temporarily and the air-fuel ratio of the exhaust gas flowing to the $SO_X$ absorbent 21 is made rich temporarily, to thereby release the $SO_X$ from the $SO_X$ absorbent 21, when an amount of $SO_X$ absorbed in the $SO_X$ absorbent 21 becomes larger than a constant amount. In this way, the $SO_X$ absorbent 21 constitutes the sulphur containing components absorbent in the present embodiment.

If the flow rate of the exhaust gas flowing through the $SO_X$ absorbent 21 is made lower when $SO_X$ is to be released from the $SO_X$ absorbent 21, the absorbed $SO_X$ is quickly released from the $SO_X$ absorbent 21, as in the above-mentioned embodiment. Thus, in the present embodiment, when $SO_X$ is to be released from the $SO_X$ absorbent 21, the flow rate SVS of the exhaust gas flowing through the $SO_X$ absorbent 21 is made lower than a predetermined flow rate SVS1, i.e., the contact period between the exhaust gas and the $SO_X$ absorbent 21 is made longer than a period required to release $SO_X$ from the $SO_X$ absorbent 21 sufficiently. Accordingly, in the present embodiment, when $SO_X$ is to be released from the $SO_X$ absorbent 21, the temperature of the $SO_X$ absorbent 21 is made higher than the $SO_X$ releasing temperature, and the air-fuel ratio of the inflowing exhaust gas is made rich, and the flow rate SVS is made lower than the predetermined flow rate SVS1. Next, the $SO_X$ releasing operation and the $NO_X$ releasing operation according to the present embodiment will be explained in more detail.

In the present embodiment, the $SO_X$ releasing operation of the $SO_X$ absorbent 21 is performed when the amount of $SO_X$ absorbed in the $SO_X$ absorbent 21 becomes larger than a constant amount, as mentioned above. It is difficult to obtain the absorbed $SO_X$ amount directly, and thus the absorbed $SO_X$ amount is estimated on the basis of the amount of $SO_X$ discharged from the engine 1, i.e., the vehicle driving distance. Namely, the absorbed $SO_X$ amount becomes larger, as the cumulative value SDD of the vehicle driving distance becomes larger. Thus, the $SO_X$ releasing operation is performed when the cumulative value SDD becomes larger than a predetermined value SDD1. The predetermined value SDD1 corresponds to about 30% of the maximum $SO_X$ amount which the $SO_X$ absorbent 21 can absorb therein, for example.

When the $SO_X$ releasing operation is to be started, first, the exhaust gas control valve 26 is closed to make the flow rate SVS lower than the predetermined flow rate SVS1. In this case, the opening VOP of the valve 26 is made VS, which is an opening required to make the flow rate SVS lower than the predetermined flow rate SVS1, and is obtained by experiments as a function of the depression DEP of the acceleration pedal and the engine speed N. This VS is stored in the ROM 32 in advance in the form of the map shown in FIG. 15.

Figure 16:
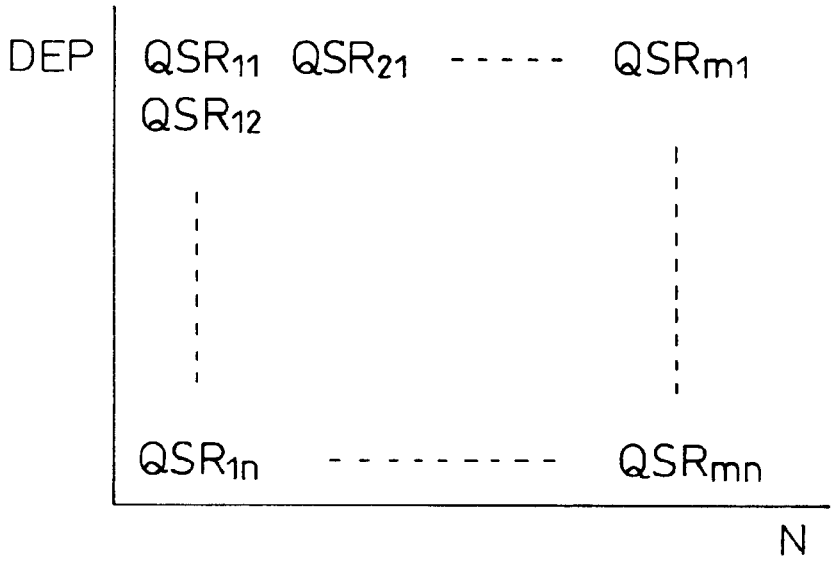
FIG. 16 is a diagram illustrating the amount of fuel to be injected secondarily for executing the $SO_X$ releasing operation.

Then, the air-fuel ratio of the exhaust gas flowing to the $SO_X$, absorbent 21 is made rich. To this end, the fuel injector 11 injects fuel secondarily at the power stroke or the exhaust stroke of the engine. The secondary fuel injection is different from the usual fuel injection performed around the top dead center of the compression stroke, and does not contribute to the engine output. In this case, the amount of the secondary fuel injection QSF is made QSR, which is a fuel injection amount required to make the air-fuel ratio of the exhaust gas flowing to the $SO_X$ absorbent 21 equal to the rich air-fuel ratio suitable for the $SO_X$ releasing operation, and is obtained, by experiment, as a function of the depression DEP and the engine speed N. This QSR is stored in the ROM 32 in advance in the form of the map shown in FIG. 16.

The secondary fuel injection provides a partial oxidation of fuel in the combustion chamber 3, and thus the fuel flow to the $SO_X$ absorbent 21 in the form of the lower hydrocarbon. As a result, CO and $H_2$ are easily produced as mentioned above, and thus the sulphate $BaSO_4$ in the $SO_X$ absorbent 21 is easily decomposed.

After the flow rate of the exhaust gas flowing through the $SO_X$ absorbent 21 is made lower and the air-fuel ratio of the exhaust gas flowing to the $SO_X$ absorbent 21 is made rich, the $SO_X$ absorbent 21 is heated. However, just after the secondary fuel injection is started, oxygen remains on the surface of the $SO_X$ absorbent 21. At this time, even though the temperature of the $SO_X$ absorbent 21 is made higher than the $SO_X$ releasing temperature, $SO_X$ is not released sufficiently. Thus, in the present embodiment, after a constant time has passed since the secondary fuel injection is started, the heating of the $SO_X$ absorbent 21 is started, i.e., the relay 28 is turned on and thus the electric heater 27 is turned on.

After this, when the temperature of the $SO_X$ absorbent 21 becomes higher than the $SO_X$ releasing temperature, the absorbed $SO_X$ is released from the $SO_X$ absorbent 21. At this time, the air-fuel ratio of the exhaust gas flowing to the $NO_X$ absorbent 16 is also rich, and thus the $SO_X$ released from the $SO_X$ absorbent 21 passes through the $NO_X$ absorbent 16 without being absorbed. Further, the $NO_X$ releasing and reducing operation of the $NO_X$ absorbent 16 is also in process at this time.

After a constant time has passed since the relay 28 is turned on, it is judged that almost all of the $SO_X$ is released from the $SO_X$ absorbent 21, and thus the $SO_X$ releasing operation is stopped. Namely, the relay 28 is turned off, and the secondary fuel injection is stopped, and the exhaust gas control valve 26 is fully opened.

The heating of the $SO_X$ absorbent 21 is started after the amount of the exhaust gas flowing through the $SO_X$ absorbent 21 is made low. Thus, the energy required to make the temperature of the $SO_X$ absorbent 21 higher than the $SO_X$ releasing temperature can be reduced.

Figure 17:
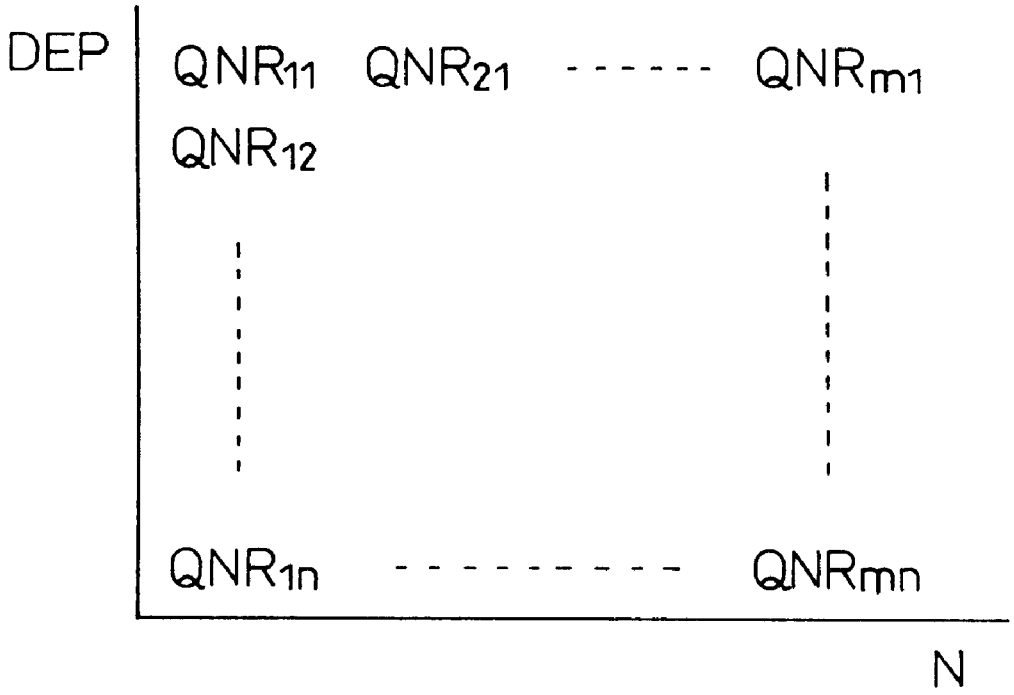
FIG. 17 is a diagram illustrating the amount of fuel to be injected secondarily for executing the $NO_X$ releasing operation.

On the other hand, when the absorbed $NO_X$ amount SN of the $NO_X$ absorbent 16 becomes higher than the predetermined amount SN1, the secondary fuel injection is performed to thereby perform the $NO_X$ releasing and reducing operation of the $NO_X$ absorbent 16. In this case, the amount of the secondary fuel injection QSF is made QNR, which is a fuel injection amount required to make the air-fuel ratio of the exhaust gas flowing to the $NO_X$ absorbent 16 equal to the rich air-fuel ratio suitable for the $NO_X$ releasing and reducing operation, and is obtained, by experiment, as a function of the depression DEP and the engine speed N. This QNR is stored in the ROM 32 in advance in the form of the map shown in FIG. 17.

Note that the $SO_X$ absorbent 21 absorbs not only $SO_X$, but also $NO_X$, therein when the air-fuel ratio of the inflowing exhaust gas is lean. The absorbed $NO_X$ is released therefrom and is reduced when the air-fuel ratio of the inflowing exhaust gas is made rich, i.e., when the $SO_X$ releasing operation of the $SO_X$ absorbent 21 or the $NO_X$ releasing operation of the $NO_X$ absorbent 16 is in process.

Figure 18:
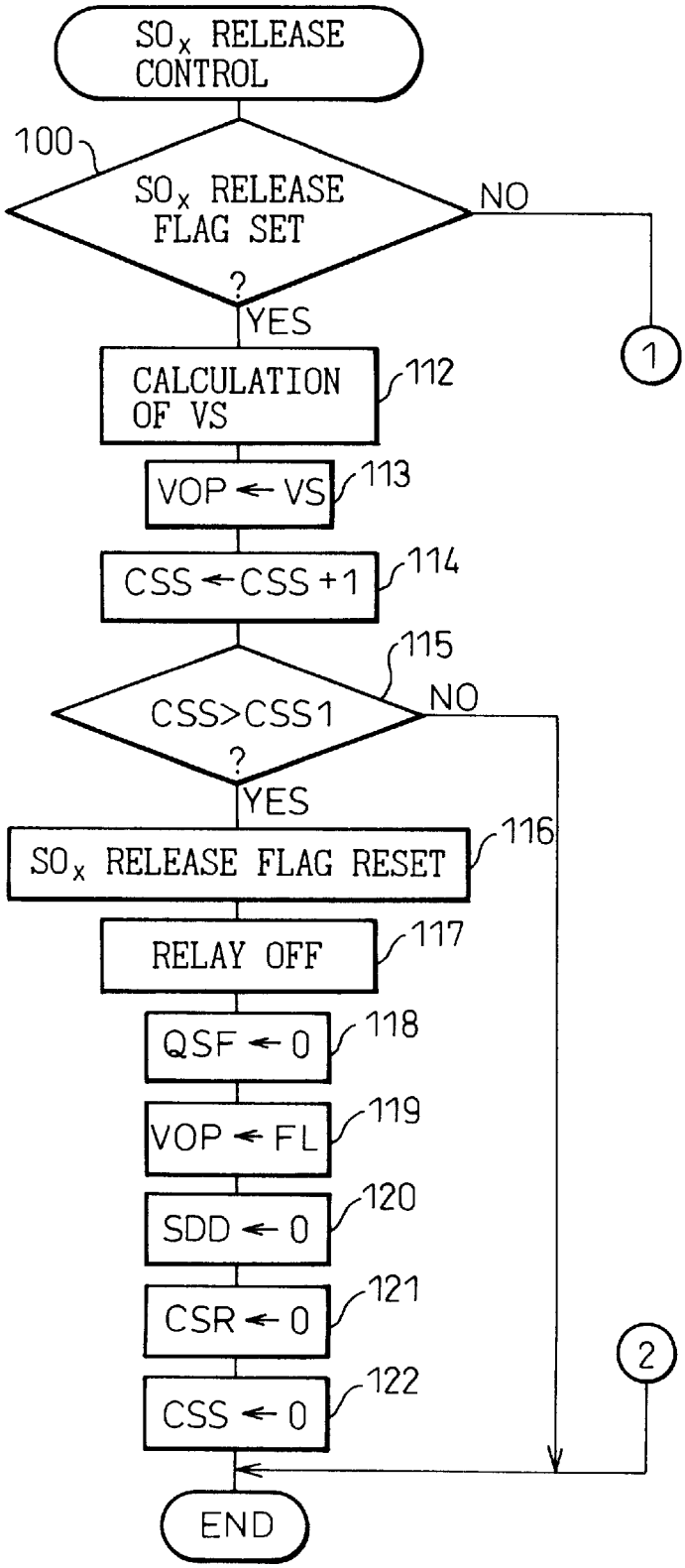
FIGS. 18 and 19 show a flowchart for controlling the $SO_X$ releasing operation according to the embodiment of FIG. 14.
Figure 19:
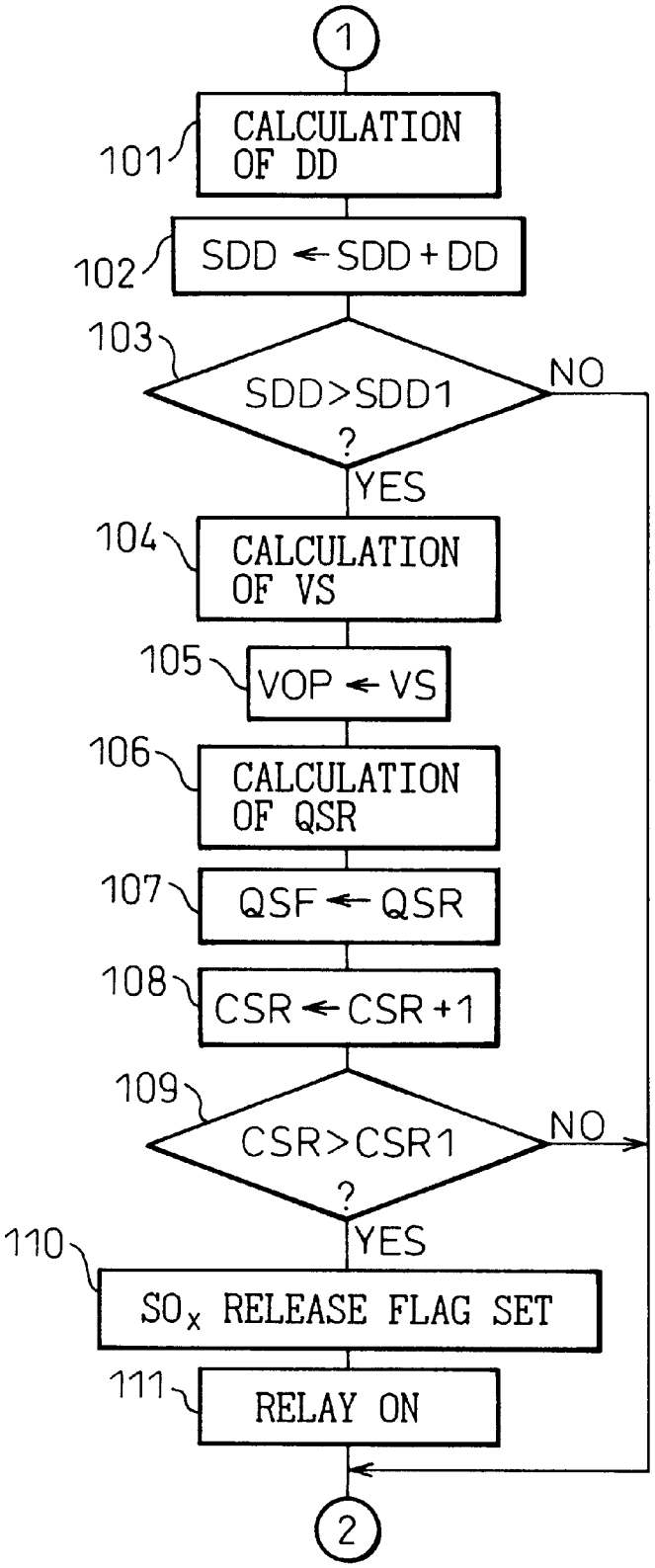

FIGS. 18 and 19 show a routine for controlling the $SO_X$ releasing operation according to the present embodiment. The routine is executed by interruption every predetermined time.

Referring to FIGS. 18 and 19, first, in step 100, it is judged whether a $SO_X$ release flag is set. The $SO_X$ release flag is set when the $SO_X$ is released from the $SO_X$ absorbent 21, and is reset when the $SO_X$ releasing operation is not in process. When the $SO_X$ release flag is reset, the routine goes to step 101, where the vehicle driving distance DD from the last processing cycle to the present processing cycle is calculated on the basis of the output pulses from the speed sensor 43. In the following step 102, the cumulative value SDD of the vehicle driving distance is calculated (SDD=SDD+DD). In the following step 103, it is judged whether the cumulative value SDD is larger than the predetermined value SDD1. When SDD≦SDD1, the processing cycle is ended. When SDD>SDD1, the routine goes to step 104, where the $SO_X$ releasing operation of the $SO_X$ absorbent 21 is started.

Figure 15:
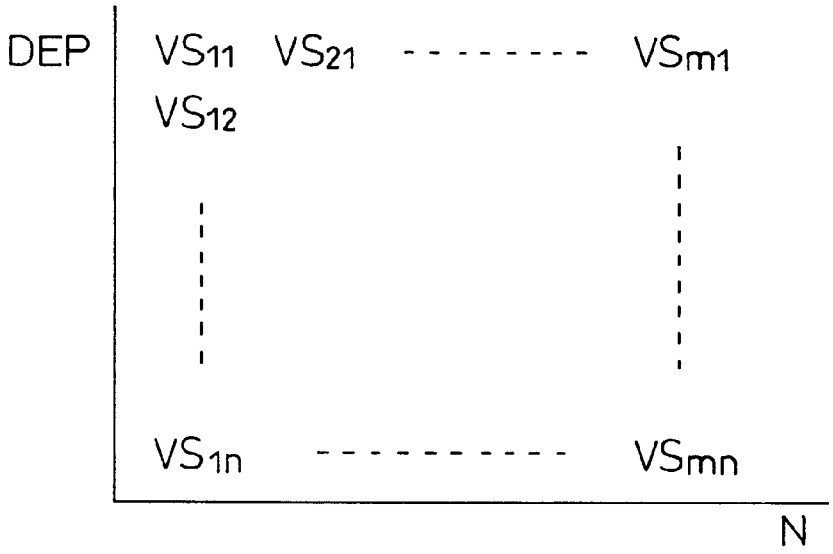
FIG. 15 is a diagram illustrating the opening VS of the exhaust gas control valve.

Namely, first, in step 104, the opening VS for making the exhaust gas control valve 26 closed is calculated using the map shown in FIG. 15. In the following step 105, the opening VOP of the valve 26 is made equal to VS. In the following step 106, the fuel injection amount QSR, for making the air-fuel ratio of the exhaust gas flowing to the $SO_X$ absorbent 21 rich, is calculated using the map shown in FIG. 16. In the following step 107, the secondary fuel injection amount QSF is made equal to QSR. In the following step 108, the counter value CSR, which represents a time from the air-fuel ratio of the exhaust gas flowing to the $SO_X$ absorbent 21 is made rich, is incremented by 1. In the following step 109, it is judged whether the counter value CSR is larger than the constant CSR1. When CSR≦CSR1, the processing cycle is ended. When CSR>CSR1, i.e., when the constant time has passed since the air-fuel ratio of the exhaust gas flowing to the $SO_X$ absorbent 21 is made rich, the routine goes to step 110, where the $SO_X$ release flag is reset. In the following step 111, the relay 28 is turned on. Thus, the heating of the $SO_X$ absorbent 21 is started.

When the $SO_X$ release flag is set, the routine goes from step 100 to step 112, where VS is calculated using the map shown in FIG. 15 and, in the following step 113, the opening VOP of the exhaust gas control valve 26 is made VS. In the following step 114, the counter value CSS, which represents a time during which the $SO_X$ release flag is set, is incremented by 1. In the following step 115, it is judged whether the counter value CSS is larger than a constant CSS1. When CSS≦CSS1, the processing cycle is ended. Thus, the $SO_X$ releasing operation is continued. Contrarily, when CS>CS1, it is judged that almost all of the $SO_X$ is released from the $SO_X$ absorbent 21, and thus the routine goes to step 116, where the $SO_X$ release flag is reset. In the following step 117, the relay 28 is turned off. In the following step 118, the secondary fuel injection amount QSF is made zero, i.e., the secondary fuel injection is stopped. In the following step 119, the opening VOP of the exhaust gas control valve 26 is made FL, which represents the full open. In the following step 120, the cumulative value SDD is cleared. In the following step 121, the counter value CSR is cleared. In the following step 122, the counter value CSS is cleared.

Figure 20:
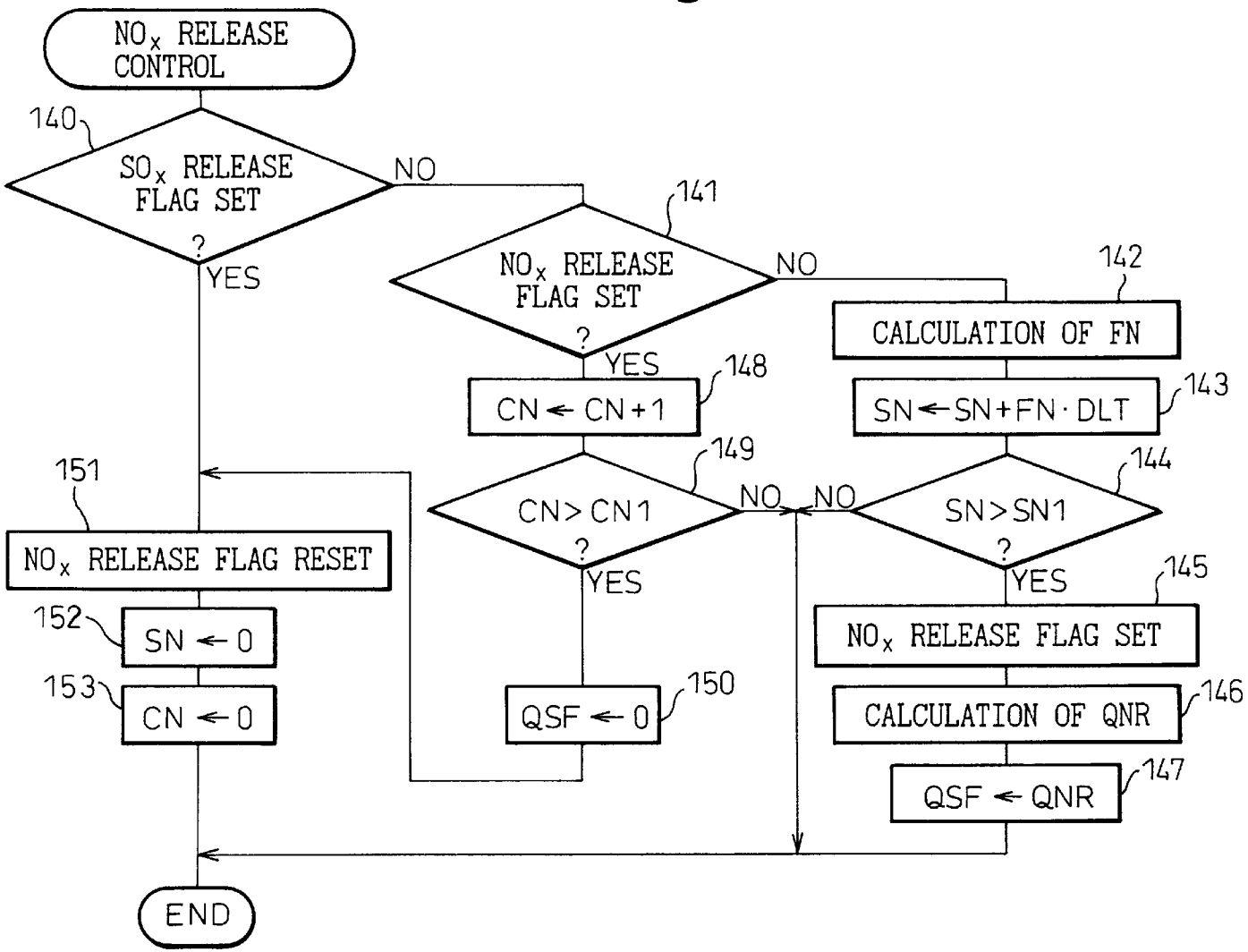
FIG. 20 shows a flowchart for controlling the $NO_X$ releasing operation according to the embodiment of FIG. 14.

FIG. 20 shows a routine for controlling the $NO_X$ releasing operation according to the present embodiment. The routine is executed by interruption every predetermined time.

Referring to FIG. 20, first, in step 140, it is judged whether the $SO_X$ release flag, which is set or reset in the routine shown in FIGS. 18 and 19, is set. When the $SO_X$ release flag is reset, i.e., when the $SO_X$ releasing operation is not in process, the routine goes to step 141, where it is judged whether a $NO_X$ release flag is set. The $NO_X$ release flag is set when the $NO_X$ is released from the $NO_X$ absorbent 16 and reduced, and is reset when the $NO_X$ releasing operation is not in process. When the $NO_X$ release flag is reset, i.e., when both of the $SO_X$ release flag and the $NO_X$ release flag are reset, the routine goes to step 142, where the inflowing $NO_X$ amount FN is calculated using the map shown in FIG. 9B. In the following step 143, the absorbed $NO_X$ amount SN is calculated (SN=SN+FN·DLT). In the following step 144, it is judged whether the absorbed $NO_X$ amount FN is larger than the predetermined amount SN1, mentioned above. When SN≦SN1, the processing cycle is ended. Contrarily, when SN>SN1, the routine goes to step 145, where the $NO_X$ release flag is set. In the following step 146, the fuel injection amount QNR, for making the air-fuel ratio of the exhaust gas flowing to the $NO_X$ absorbent 16 rich, is calculated using the map shown in FIG. 17. In the following step 147, the secondary fuel injection amount QSF is made equal to QNR.

When the $NO_X$ release flag is set, the routine goes from step 141 to step 148, where the counter value CN, which represents a time during which the $NO_X$ release flag is set, is incremented by 1. In the following step 149, it is judged whether the counter value CN is larger than a constant CN1. When CN≦CN1, the processing cycle is ended. Contrarily, when CN≧CN1, it is judged that almost all of the $NO_X$ is released from the $NO_X$ absorbent 16, and thus the routine goes to step 150, where the secondary fuel injection amount QSR is made zero. In the following step 151, the $NO_X$ release flag is reset. In the following step 152, the absorbed $NO_X$ amount SN is cleared. In the following step 153, the counter value CN is cleared.

Contrarily, when the $SO_X$ release flag is set, the routine goes from step 140 to steps 151 to 153. As mentioned above, when the $SO_X$ releasing operation of the $SO_X$ absorbent 21 is in process, the $NO_X$ releasing operation of the $NO_X$ absorbent 16 is also in process. Further, when the $SO_X$ releasing operation is finished, the $NO_X$ releasing operation is also finished. Thus, when the $SO_X$ release flag is set, the $NO_X$ release flag is reset or kept reset, and the absorbed $NO_X$ amount SN and the counter value CN are cleared.

Figure 21:
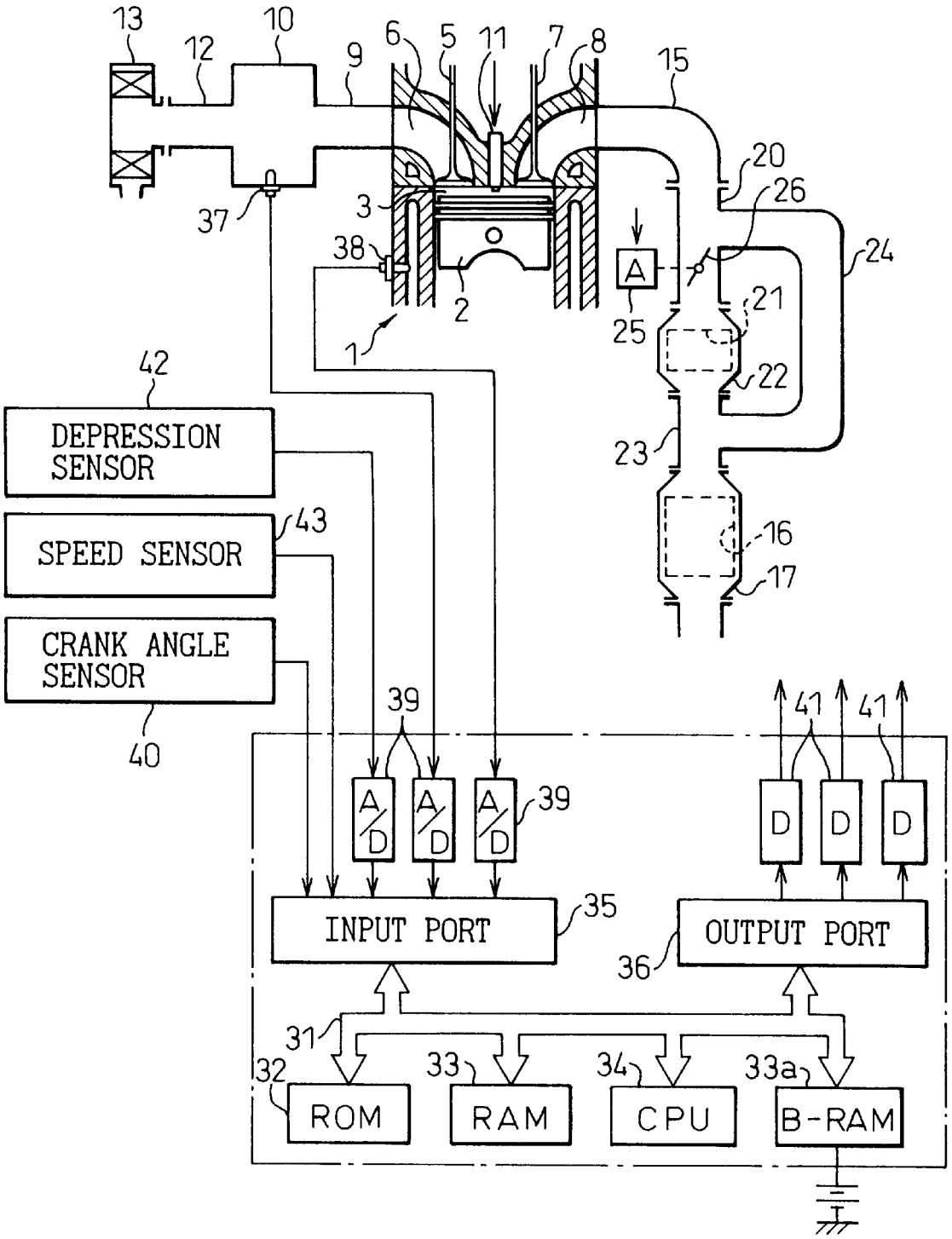
FIG. 21 is a general view of an engine according to another embodiment of the present invention.

FIG. 21 illustrates another embodiment.

The present embodiment is different from the embodiment shown in FIG. 14 in the point that the electric heater 27, the relay 28, and the battery 29 are not provided.

When the secondary fuel injection is performed, a part of the secondary fuel is burned in the combustion chamber 3 or the exhaust passage. Thus, the temperature of the exhaust gas flowing to the $SO_X$ absorbent 21 is made higher by increasing the amount of the secondary fuel to be burned in the combustion chamber 3 or the exhaust passage. Therefore, in the present embodiment, the timing of the secondary fuel injection when the $SO_X$ releasing operation of the $SO_X$ absorbent 21 is in process is made earlier or more advanced than that when the $NO_X$ releasing operation of the $NO_X$ absorbent 16 is in process.

Namely, the secondary fuel injection timing RTD for the $NO_X$ releasing operation is set between 180 to 210° crank angle after the top dead center of the compression stroke. Contrarily, the secondary fuel injection timing ADV for the $SO_X$ releasing operation is set between 90 to 180° crank angle after the top dead center of the compression stroke. As a result, the temperature of the $SO_X$ absorbent 21 is made higher than the $SO_X$ releasing temperature without the electric heater.

Figure 22:
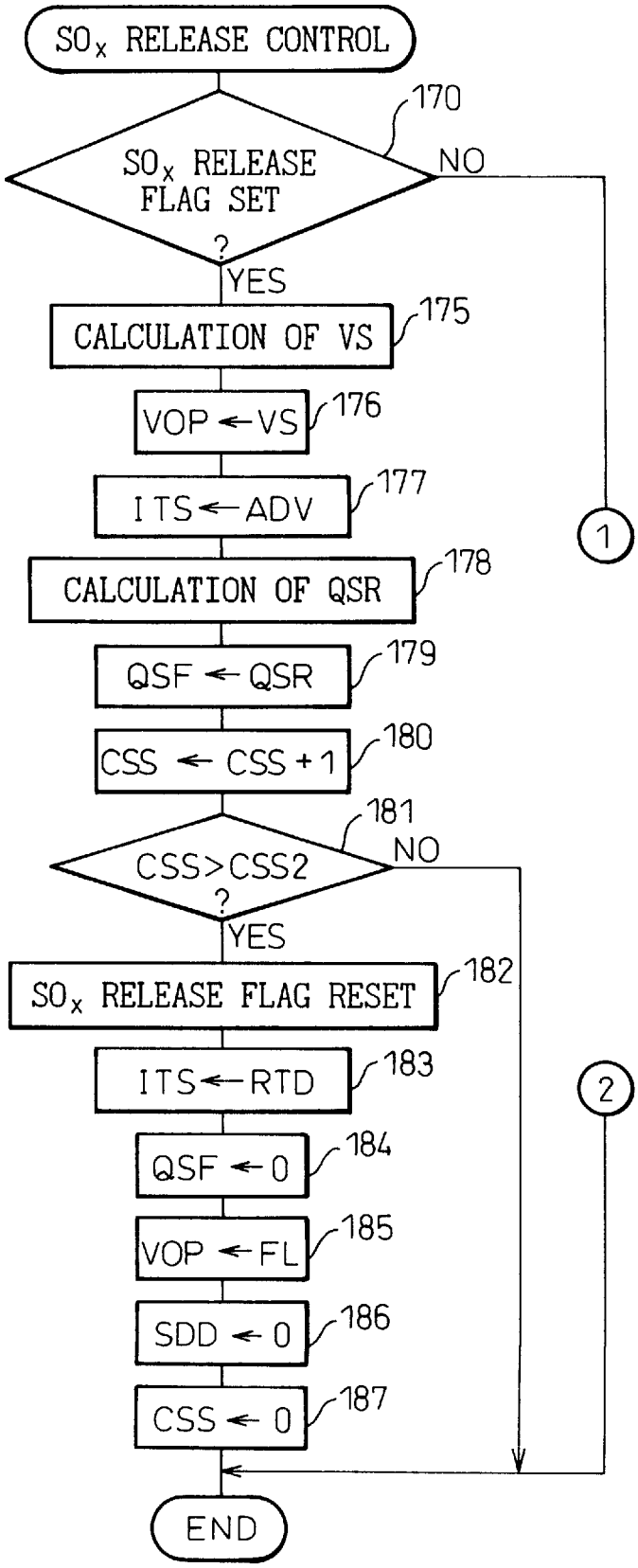
FIGS. 22 and 23 show a flowchart for controlling the $SO_X$ releasing operation according to the embodiment of FIG. 21.
Figure 23:
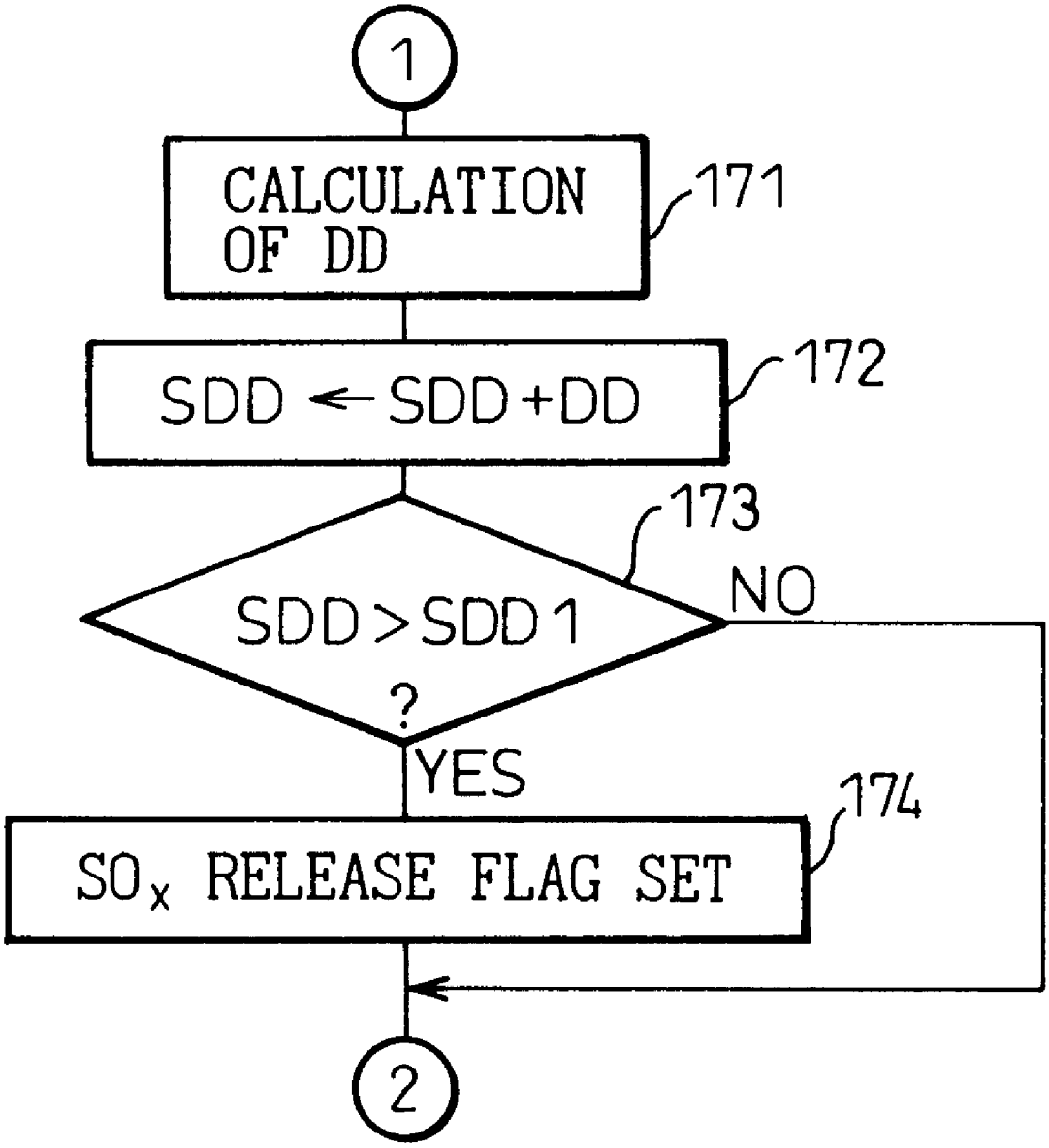

FIGS. 22 and 23 show a routine for controlling the $SO_X$ releasing operation according to the present embodiment. The routine is executed by interruption every predetermined time. Note that the routine for controlling the $NO_X$ releasing operation shown in FIG. 20 is executed in the present embodiment.

Referring to FIGS. 22 and 23, first, in step 170, it is judged whether a $SO_X$ release flag is set. The $SO_X$ release flag is set when the $SO_X$ is released from the $SO_X$ absorbent 21, and is reset when the $SO_X$ releasing operation is not in process. When the $SO_X$ release flag is reset, the routine goes to step 171, where the vehicle driving distance DD from the last processing cycle to the present processing cycle is calculated on the basis of the output pulses from the speed sensor 43. In the following step 172, the cumulative value SDD of the vehicle driving distance is calculated (SDD=SDD+DD). In the following step 173, it is judged whether the cumulative value SDD is larger than the predetermined value SDD1. When SDD≦SDD1, the processing cycle is ended. When SDD>SDD1, the routine goes to step 174. where the $SO_X$ release flag is set.

When the $SO_X$ release flag is set, the routine goes from step 170 to step 175, where the opening VS for making the exhaust gas control valve 26 closed is calculated using the map shown in FIG. 15. In the following step 176, the opening VOP of the valve 26 is made equal to VS. In the following step 177, the secondary fuel injection timing ITS is made equal to ADV which is set in the advanced side. In the following step 178, the fuel injection amount QSR for making the air-fuel ratio of the exhaust gas flowing to the $SO_X$ absorbent 21 rich, is calculated using the map shown in FIG. 16. In the following step 179, the secondary fuel injection amount QSF is made equal to QSR. In the following step 180, the counter value CSS, which represents a time during which the $SO_X$ release flag is set, is incremented by 1. In the following step 181, it is judged whether the counter value CSS is larger than a constant CSS2. When CSS≦CSS2, the processing cycle is ended. Contrarily, when CS>CS2, it is judged that almost all of the $SO_X$ is released from the $SO_X$ absorbent 21, and thus the routine goes to step 182, where the $SO_X$ release flag is reset. In the following step 183, the secondary fuel injection timing ITS is made equal to RTD which is set to the retarded side. Thus, when the $NO_X$ releasing operation of the $NO_X$ absorbent 16 is started, the secondary fuel injection is performed with the timing RTD. In the following step 184, the secondary fuel injection amount QSF is made zero, i.e., the secondary fuel injection is stopped. In the following step 185, the opening VOP of the exhaust gas control valve 26 is made FL, which represents full open. In the following step 186, the cumulative value SDD is cleared. In the following step 187, the counter value CSS is cleared.

According to the present invention, it is possible to provide a device for purifying an exhaust gas of an engine capable of releasing the absorbed sulphur containing components from the sulphur containing components absorbent rapidly and sufficiently.

While the invention has been described by reference to specific embodiments chosen for purposes of illustration, it should be apparent that numerous modifications could be made thereto by those skilled in the art without departing from the basic concept and scope of the invention.

We claim:

1. A device for purifying the exhaust gas of an engine having an exhaust passage, comprising:

a sulphur containing components absorbent arranged in the exhaust passage, the sulphur containing components absorbent absorbing the sulphur containing components therein when the air-fuel ratio of the inflowing exhaust gas is lean, and releasing the absorbed sulphur containing components therefrom when the oxygen concentration in the inflowing exhaust gas becomes lower with the temperature of the sulphur containing components absorbent being higher than a sulphur containing components releasing temperature of the sulphur containing components absorbent; and releasing means for making the air-fuel ratio of the exhaust gas flowing to the sulphur containing components absorbent stoichiometric or rich temporarily, when the temperature of the sulphur containing components absorbent is higher than the sulphur containing components releasing temperature and when the flow rate of the exhaust gas flowing through the sulphur containing components absorbent is lower than a predetermined flow rate, to release the absorbed sulphur containing components from the sulphur containing components absorbent.

2. A device according to claim 1, wherein the sulphur containing components is comprised of sulphur oxide $SO_X$.

3. A device according to claim 1, wherein the air-fuel ratio of the air-fuel mixture to be burned in the combustion chamber of the engine is made stoichiometric or rich, to make the air-fuel ratio of the exhaust gas flowing to the sulphur containing components absorbent stoichiometric or rich.

4. A device according to claim 1, wherein the engine is provided with a fuel injector injecting fuel directly into the combustion chamber of the engine, and wherein the releasing means controls the fuel injector to inject fuel secondarily at the power stroke or the exhaust stroke of the engine, to make the air-fuel ratio of the exhaust gas flowing to the sulphur containing components absorbent stoichiometric or rich.

5. A device according to claim 1, further comprising judging means for judging whether the temperature of the sulphur containing components absorbent is higher than the sulphur containing components releasing temperature and whether the flow rate of the exhaust gas flowing through the sulphur containing components absorbent is lower than the predetermined flow rate, wherein the air-fuel ratio of the exhaust gas flowing to the sulphur containing components absorbent is made stoichiometric or rich temporarily when the temperature of the sulphur containing components absorbent is judged to be higher than the sulphur containing components releasing temperature and the flow rate of the exhaust gas flowing through the sulphur containing components absorbent is judged to be lower than the predetermined flow rate.

6. A device according to claim 5, wherein the judging means judges whether the temperature of the sulphur containing components absorbent is higher than the sulphur containing components releasing temperature on the basis of the engine operating condition.

7. A device according to claim 5, wherein the judging means judges whether the flow rate of the exhaust gas flowing through the sulphur containing components absorbent is lower than the predetermined flow rate on the basis of the engine operating condition.

8. A device according to claim 1, further comprising temperature control means for controlling the temperature of the sulphur containing components absorbent to make the temperature higher than the sulphur containing components releasing temperature.

9. A device according to claim 8, wherein the temperature control means comprises an electric heater to heat the sulphur containing components absorbent.

10. A device according to claim 8, wherein the engine is provided with a fuel injector injecting fuel directly into the combustion chamber of the engine, and wherein the temperature control means controls the fuel injector to inject fuel secondarily at the power stroke or the exhaust stroke of the engine, to heat the sulphur containing components absorbent.

11. A device according to claim 8, further comprising estimating means for estimating an amount of sulphur containing components absorbed in the sulphur containing components absorbent, wherein the temperature control means makes the temperature of the sulphur containing components absorbent higher than the sulphur containing components releasing temperature when the estimated sulphur containing components amount is larger than a predetermined amount.

12. A device according to claim 1, further comprising flow rate control means for controlling the flow rate of the exhaust gas flowing through the sulphur containing components absorbent to make the flow rate lower than the predetermined flow rate.

13. A device according to claim 12, wherein the flow rate control means comprises reducing means for reducing an amount of the exhaust gas flowing to the sulphur containing components absorbent to make the flow rate of the exhaust gas flowing through the sulphur containing components absorbent lower than the predetermined flow rate.

14. A device according to claim 13, wherein the reducing means comprises a release passage connected to the exhaust passage upstream of the sulphur containing components absorbent, and means for introducing the exhaust gas from the engine to the release passage, and wherein the amount of the exhaust gas introduced to the release passage is increased to make the flow rate of the exhaust gas flowing through the sulphur containing components absorbent lower than the predetermined flow rate.

15. A device according to claim 12, further comprising estimating means for estimating an amount of sulphur containing components absorbed in the sulphur containing components absorbent, wherein the flow rate control means makes the flow rate of the exhaust gas flowing through the sulphur containing components absorbent lower than the predetermined flow rate when the estimated sulphur containing components amount is larger than a predetermined amount.

16. A device according to claim 1, wherein the sulphur containing components absorbent comprises a $NO_X$ absorbent, the $NO_X$ absorbent absorbing $NO_X$ therein when the air-fuel ratio of the inflowing exhaust gas is lean, and releasing the absorbed $NO_X$ therefrom when the oxygen concentration in the inflowing exhaust gas becomes lower.

17. A device according to claim 16, wherein the $NO_X$ absorbent is comprised of at least one substance, selected from alkali metals such as potassium, sodium, lithium, and cesium, alkali earth metals such as barium and calcium, rare earth metals such as lanthanum and yttrium, and of precious metals such as platinum, carried on a carrier.

18. A device according to claim 16, further comprising means for making the air-fuel ratio of the exhaust gas flowing to the $NO_X$ absorbent temporarily stoichiometric or rich, to release the absorbed $NO_X$ from the $NO_X$ absorbent.

19. A device according to claim 1, wherein the sulphur containing components absorbent comprises a $SO_X$ absorbent, the $SO_X$ absorbent absorbing $SO_X$ therein when the air-fuel ratio of the inflowing exhaust gas is lean, and releasing the absorbed $SO_X$ therefrom when the oxygen concentration in the inflowing exhaust gas becomes lower with the temperature of the $SO_X$ absorbent being higher than a $SO_X$ releasing temperature of the $SO_X$ absorbent.

20. A device according to claim 19, wherein the $SO_X$ absorbent is comprised of at least one substance, selected from lithium and transition metals such as iron, copper, manganese, nickel, and tin, carried on a carrier.

21. A device according to claim 19, further comprising a $NO_X$ absorbent arranged in the exhaust passage downstream of the $SO_X$ absorbent, the $NO_X$ absorbent absorbing $NO_X$ therein when the air-fuel ratio of the inflowing exhaust gas is lean, and releasing the absorbed $NO_X$ therefrom when the oxygen concentration in the inflowing exhaust gas becomes lower.

22. A device according to claim 21, wherein the $NO_X$ absorbent is comprised of at least one substance, selected from alkali metals such as potassium, sodium, lithium, and cesium, alkali earth metals such as barium and calcium, rare earth metals such as lanthanum and yttrium, and of precious metals such as platinum, carried on a carrier.

23. A device according to claim 21, further comprising a bypass passage connecting the exhaust passage upstream of the $SO_X$ absorbent and the exhaust passage between the $SO_X$ absorbent and the $NO_X$ absorbent, and means for introducing the exhaust gas from the engine to the bypass passage, and wherein the amount of the exhaust gas introduced into the bypass passage is increased to make the flow rate of the exhaust gas flowing through the $SO_X$ absorbent lower than the predetermined flow rate.

24. A device according to claim 21, further comprising means for making the air-fuel ratio of the exhaust gas flowing to the $NO_X$ absorbent temporarily stoichiometric or rich, to release the absorbed $NO_X$ from the $NO_X$ absorbent.

25. A device according to claim 1, wherein the air-fuel ratio of the air-fuel mixture to be burned in the combustion chamber of the engine is usually made lean.

* * * * *

UNITED STATES PATENT AND TRADEMARK OFFICE

CERTIFICATE OF CORRECTION

PATENT NO. : 6,058,700

DATED : May 9, 2000

INVENTOR(S) :

YAMASHITA, et al.

It is certified that error appears in the above-indentified patent and that said Letters Patent is hereby corrected as shown below:

On the first page, item [30] Foreign Application Priority Data, should be inserted to read:

| | | | |
|---|---|---|---|
| -May 26, 1997 | [JP] | Japan | 9-135217 |
| April 30, 1998 | [JP] | Japan | 10-121-080--. |

Signed and Sealed this

Third Day of April, 2001

*Attest:*

Nicholas P. Godici

NICHOLAS P. GODICI

*Attesting Officer*

*Acting Director of the United States Patent and Trademark Office*